US010295956B2

(12) United States Patent
Enokuchi et al.

(10) Patent No.: US 10,295,956 B2
(45) Date of Patent: May 21, 2019

(54) DEVELOPER SUPPLY CONTAINER

(71) Applicant: CANON KABUSHIKI KAISHA, Tokyo (JP)

(72) Inventors: Takashi Enokuchi, Tokyo (JP); Manabu Jimba, Toride (JP); Ayatomo Okino, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/685,412

(22) Filed: Aug. 24, 2017

(65) Prior Publication Data

US 2017/0351212 A1 Dec. 7, 2017

Related U.S. Application Data

(60) Division of application No. 15/098,528, filed on Apr. 14, 2016, now abandoned, which is a division of (Continued)

(30) Foreign Application Priority Data

Mar. 11, 2013 (JP) ..... 2013-047971

(51) Int. Cl.
*G03G 15/08* (2006.01)
*G03G 21/16* (2006.01)

(52) U.S. Cl.
CPC ..... *G03G 21/1647* (2013.01); *G03G 15/087* (2013.01); *G03G 15/0865* (2013.01); (Continued)

(58) Field of Classification Search
USPC ..... 399/25, 27–30, 107, 110, 119, 120, 399/252–263
See application file for complete search history.

(56) References Cited

U.S. PATENT DOCUMENTS 6,687,478 B2 2/2004 Sugita
6,839,533 B2 * 1/2005 Ban ..... G03G 15/0877 399/120

(Continued)

FOREIGN PATENT DOCUMENTS

CN 1 754 132 A 3/2006
EP 1 973 009 9/2008

(Continued)

OTHER PUBLICATIONS

Written Opinion of the International Searching Authority and International Search Report in International Patent Application No. PCT/JP2013/060407.

(Continued)

*Primary Examiner* — Hoan H Tran
(74) *Attorney, Agent, or Firm* — Venable LLP

(57) ABSTRACT

A developer supply container detachably mountable to a developer receiving apparatus, the developer supply container includes an accommodating portion for accommodating a developer; a discharge opening for discharging the developer accommodated in the accommodating portion from the developer supply container; a developer feeding portion for feeding the developer in the accommodating portion toward the discharge opening; a rotatable drive receiving portion for receiving a rotational force; a drive transmitting portion for transmitting the rotational force received by the drive receiving portion to the feeding portion; a portion-to-be-detected for detecting rotation of the drive receiving portion; a contact surface for contacting a rotatable member provided in the developer receiving apparatus; wherein the drive receiving portion, the portion-to-be-detected and the contact are formed integrally.

4 Claims, 29 Drawing Sheets

Related U.S. Application Data application No. 14/850,004, filed on Sep. 10, 2015, now Pat. No. 9,348,261, which is a continuation of application No. PCT/JP2013/060407, filed on Mar. 9, 2013.

(52) U.S. Cl.
CPC ..... *G03G 15/0867* (2013.01); *G03G 15/0877* (2013.01); *G03G 15/0872* (2013.01)

(56) References Cited

U.S. PATENT DOCUMENTS

| | | | | |
|---|---|---|---|---|
| 7,050,728 | B2 | 5/2006 | Minagawa et al. | |
| 7,283,773 | B2 | 10/2007 | Amano | |
| 7,321,744 | B2 | 1/2008 | Hosokawa et al. | |
| 7,738,817 | B2 | 6/2010 | Sasae et al. | |
| 8,000,614 | B2 | 8/2011 | Okino et al. | |
| 8,068,748 | B2 | 11/2011 | Pearce | |
| 8,170,452 | B2 | 5/2012 | Tamura | |
| 8,254,795 | B2 | 8/2012 | Koizumi | |
| 8,565,649 | B2 | 10/2013 | Murakami et al. | |
| 8,655,234 | B2 * | 2/2014 | Hori | G03G 15/0886 399/258 |
| 8,843,034 | B2 * | 9/2014 | Yamane | G03G 15/0863 399/262 |
| 8,965,250 | B2 * | 2/2015 | Komatsu | G03G 15/0839 222/DIG. 1 |
| 9,348,261 | B2 * | 5/2016 | Enokuchi | G03G 15/087 |
| 2007/0140743 | A1 | 6/2007 | Kamimura | |
| 2009/0269088 | A1 | 10/2009 | Mizuta | |
| 2010/0209141 | A1 | 8/2010 | Ikado | |
| 2013/0011165 | A1 | 1/2013 | Inoue | |
| 2013/0039678 | A1 | 2/2013 | Yoshida et al. | |
| 2014/0153974 | A1 | 6/2014 | Jimba et al. | |

FOREIGN PATENT DOCUMENTS

| | | | |
|---|---|---|---|
| EP | 1 751 626 | | 2/2013 |
| JP | H07-20707 | A | 1/1995 |
| JP | 2004-280064 | A | 10/2004 |
| JP | 2005-148238 | A | 6/2005 |
| JP | 2005-181475 | A | 7/2005 |
| JP | 2009-116120 | A | 5/2009 |
| JP | 2009-265369 | A | 11/2009 |
| JP | 2013-015826 | A | 1/2013 |
| TW | 201113653 | A | 4/2011 |
| TW | 201207581 | A1 | 2/2012 |
| TW | 201300971 | A1 | 1/2013 |

OTHER PUBLICATIONS

Office Action in Taiwanese Patent Application No. 104139460, dated Oct. 24, 2016.
Office Action in Taiwanese Patent Application No. 107101892, dated Mar. 12, 2018.
Office Action in Japanese Patent Application No. 2017-085123, dated Mar. 6, 2018.
Notice of Allowance in Taiwanese Patent Application No. 106120773, dated Dec. 15, 2017.
Office Action in Japanese Patent Application No. 2017-085123, dated Oct. 2, 2018.
Office Action in Chinese Patent Application No. 201380075685.X, dated Dec. 21, 2018 (with English translation).
Notice of Allowance in Taiwanese Patent Application No. 107137025, dated Mar. 27, 2019.

* cited by examiner (a)

(b)

(a)

(b)

(a)

(b)

(a)

(b)

(a)

(b)

DEVELOPER SUPPLY CONTAINER

FIELD OF THE INVENTION

The present invention relates to an image forming apparatus of an electrophotographic type or electrostatic recording type, and a developer supply container usable with the same, more particularly to an image forming apparatus such as a copying machine, a printer or a facsimile machine or the like, and a developer supply container usable with the same.

BACKGROUND ART

Conventionally, an image forming apparatus of an electrophotographic type such as a copying machine uses a fine powder developer. In such an image forming apparatus, the developer consumed with image forming operations is supplied from the developer supply container.

Regarding the developer supply, various types have been proposed and practically used, and in widely used types, a driving force is applied from a developer receiving apparatus to rotate the developer supply container, thereby supplies the developer.

In addition, one of means for determining a developer remainder in the developer supply container uses detection of a phase (number of rotations) of the developer supply container.

As for the conventional method for detecting the phase (number of rotations) of the developer supply container, one is disclosed in Japanese Laid-open Patent Application 2005-148238.

In the device disclosed in Japanese Laid-open Patent Application 2005-148238, a driving force is supplied from a main assembly of the image forming apparatus to a drive receiving portion provided on an outer periphery of the substantially cylindrical developer supply container, and the number of rotations is detected by an encoder provided in the image formation main assembly side of the apparatus.

In addition, in the apparatus disclosed in Japanese Laid-open Patent Application 2005-148238, a roller is provided in a developer receiving apparatus side to reduce friction during rotation of the developer supply container. The developer supply container can be smoothly rotated by the roller rotating in contact with the substantially cylindrical developer supply container. Therefore, the developer supply can be carried out properly, and the number of rotations of the developer supply container can be detected.

SUMMARY OF THE INVENTION

Problem to be Solved

However, in the device disclosed in Japanese Laid-open Patent Application 2005-148238, the drive receiving portion of the substantially cylindrical developer supply container and the roller are at positions away from each other in the thrust direction of the developer supply container, and the portion of the developer supply container which contact the roller is formed with a spiral groove for feeding the developer. Therefore, there is a possibility that a fluctuation of rotation of the developer supply container may occur during the developer supply. Such a behavior of the developer supply container is preferably small, in the case of the detecting the stop position of the developer supply container as well as the detection of the number of rotations of the developer supply container.

Accordingly, it is an object of the present invention to provide a developer supply container with which the fluctuation of rotation of the developer supply container during the developer supply operation is reduced to decrease the influence to the detection of the phase (rotation) of the developer supply container.

Means for Solving the Problem

The present invention provides developer supply container detachably mountable to a developer receiving apparatus, said developer supply container comprising an accommodating portion for accommodating a developer; a discharge opening for discharging the developer accommodated in said accommodating portion from said developer supply container; a developer feeding portion for feeding the developer in said accommodating portion toward said discharge opening; a rotatable drive receiving portion for receiving a rotational force; a drive transmitting portion for transmitting the rotational force received by said drive receiving portion to said feeding portion; a portion-to-be-detected for detecting rotation of said drive receiving portion; a contact surface for contacting a rotatable member provided in the developer receiving apparatus; wherein said drive receiving portion, said portion-to-be-detected and said contact are formed integrally.

Effects of the Invention

According to the present invention, the influence, to the portion-to-be-detected, of the driving force received by the drive receiving portion can be reduced.

Figure 9:
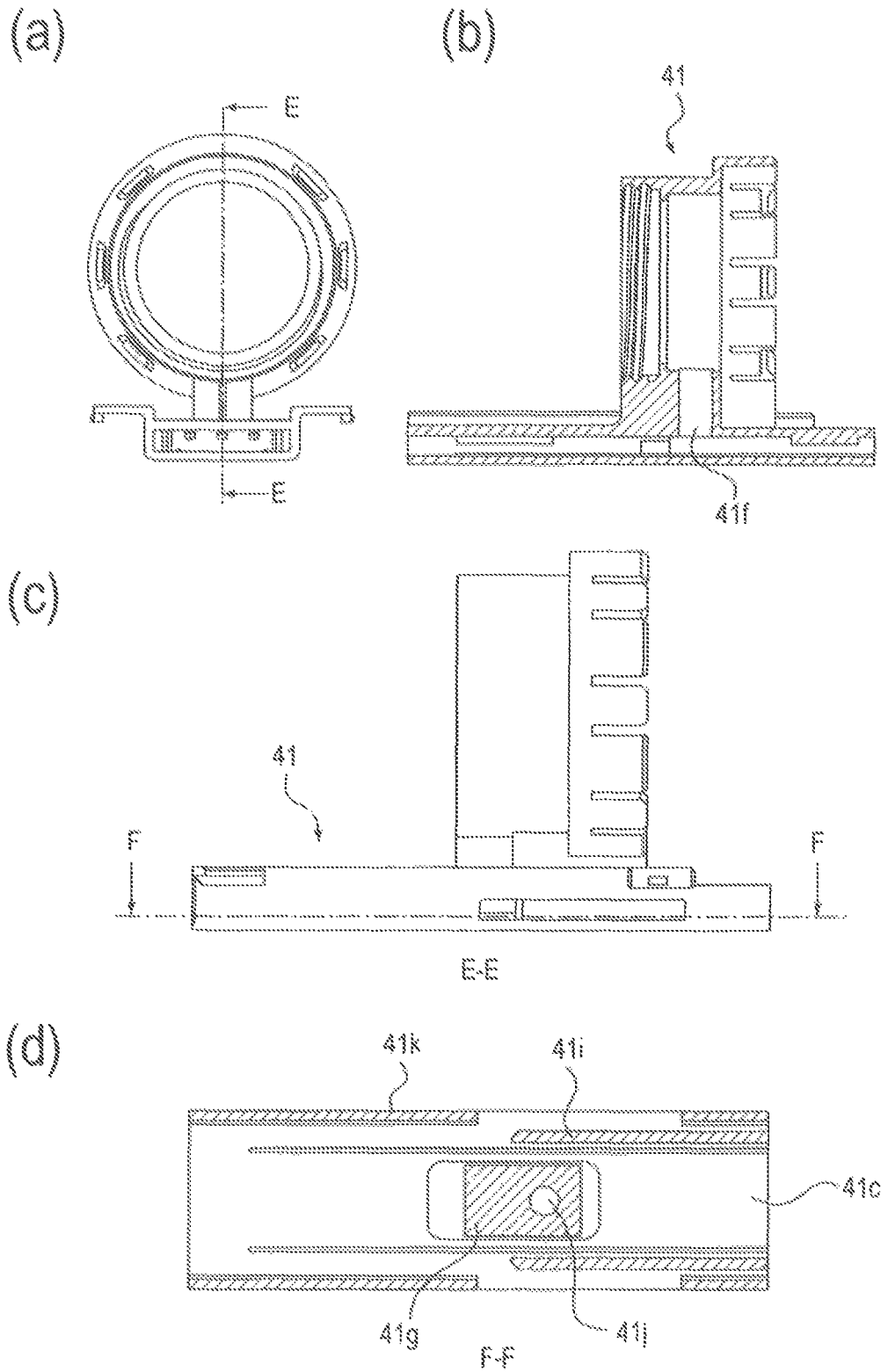

Part (a) of FIG. 9 is a front view of the flange portion in Embodiment 1, part (b) of FIG. 9 is an E-E sectional view, part (c) of FIG. 9 is a right-hand side view, and part (d) of FIG. 9 is an F-F sectional view.

Figure 10:
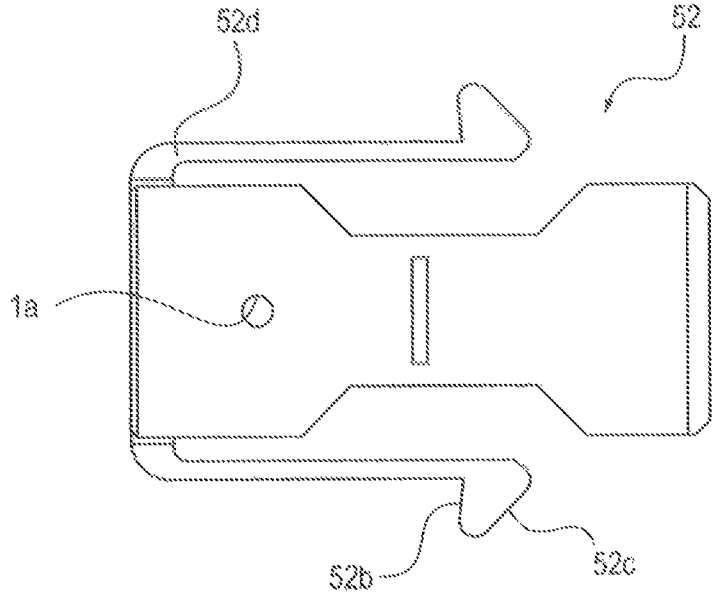
Figure 10:
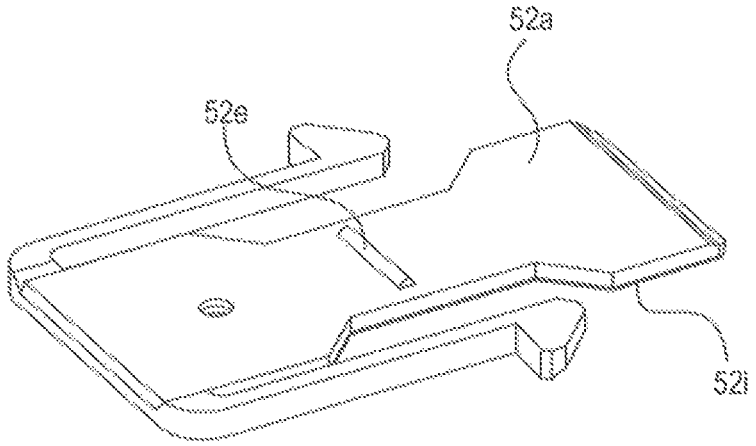

Part (a) of FIG. 10 is a front view of a shutter in Embodiment 1, and part (b) of FIG. 10 is a perspective view thereof.

Figure 11:
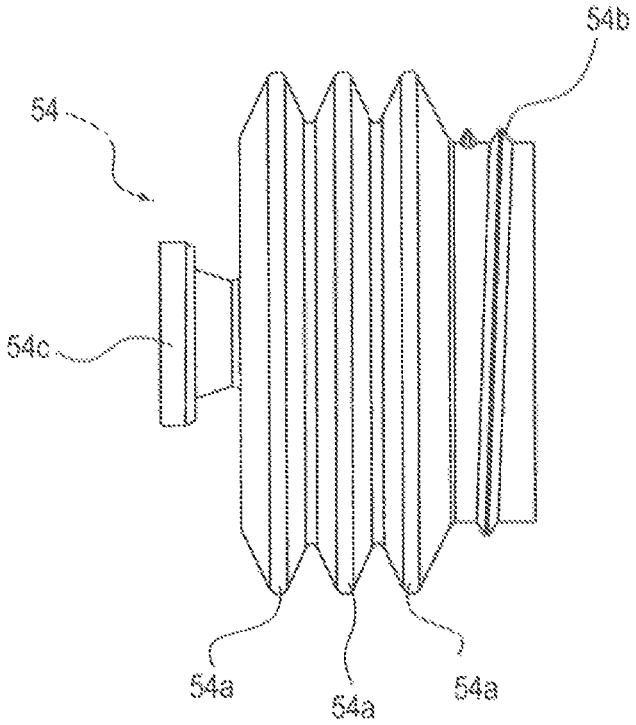

FIG. 11 is a front view of a pump portion in Embodiment 1.

Figure 12:
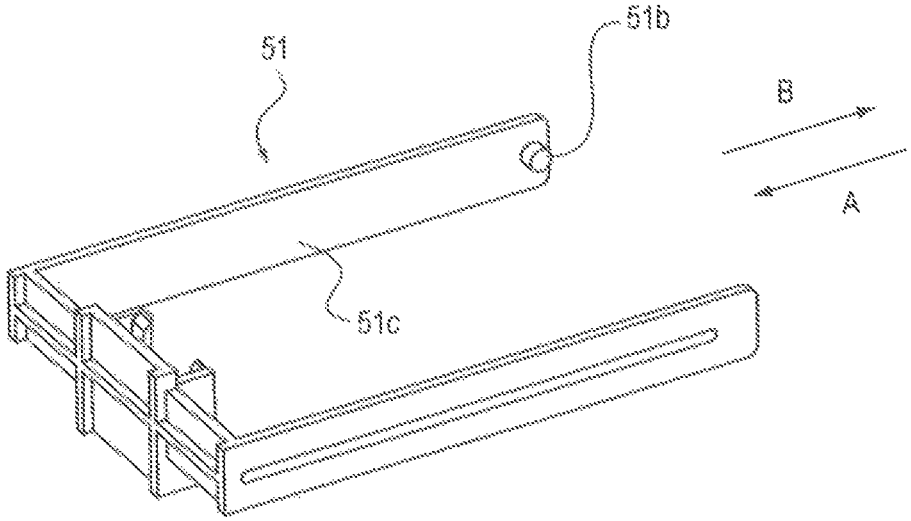
Figure 12:
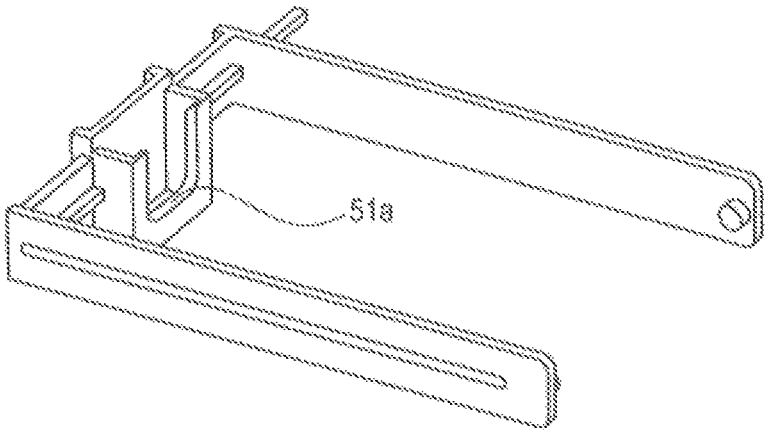

FIG. 12 is a perspective view of a reciprocating member in Embodiment 1.

Figure 13:
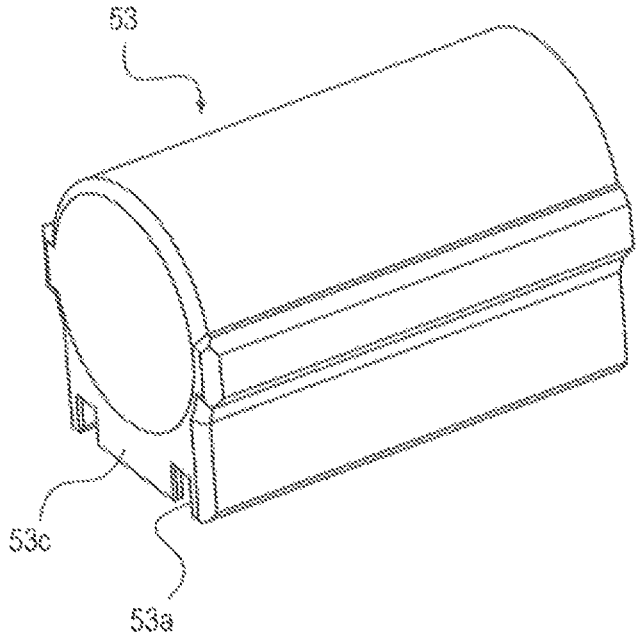
Figure 13:
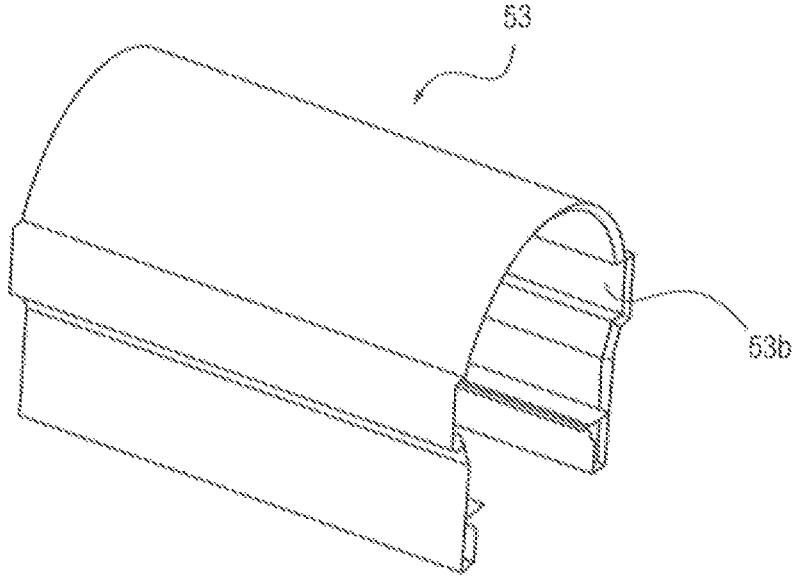

FIG. 13 is a perspective view of a cover in Embodiment 1.

Figure 14:
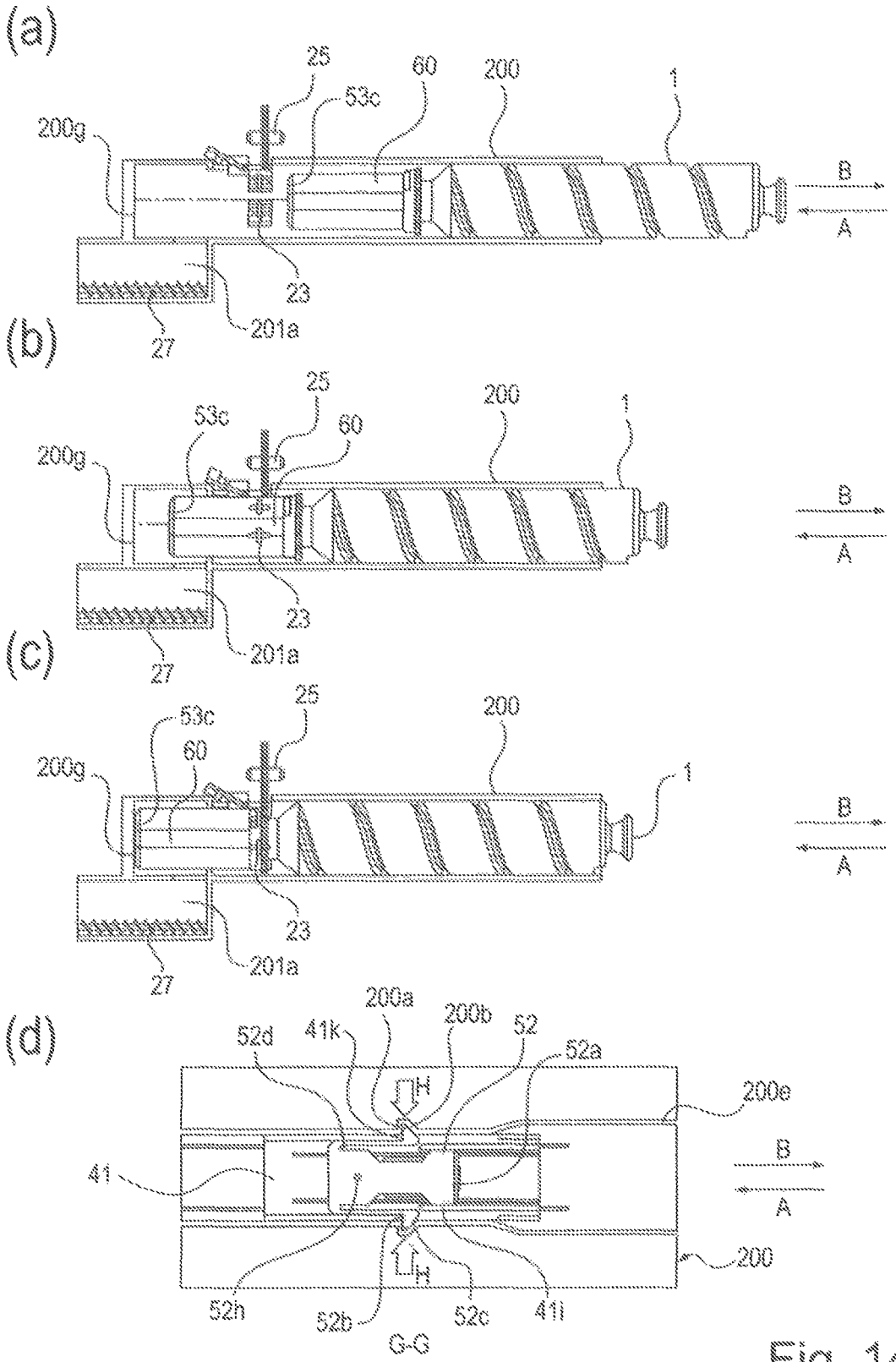
Figure 15:
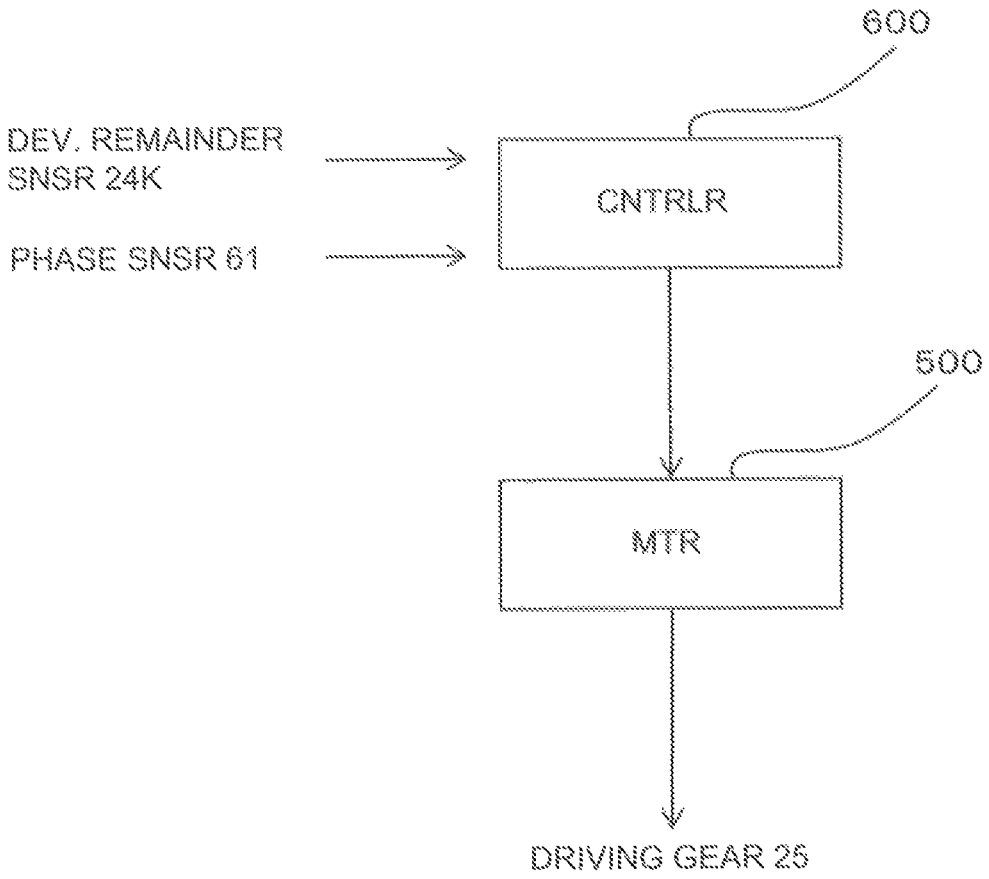

Parts (a)-(c) of FIG. 14 are partially sectional views illustrating steps of insertion of the developer supply container into the developer receiving apparatus in Embodiment 1, and part (d) illustrates the states halfway of insertion of the developer supply container into the developer receiving apparatus. FIG. 15 is a block diagram showing a function and a structure of a control device in Embodiment 1 and Embodiment 2.

Figure 16:
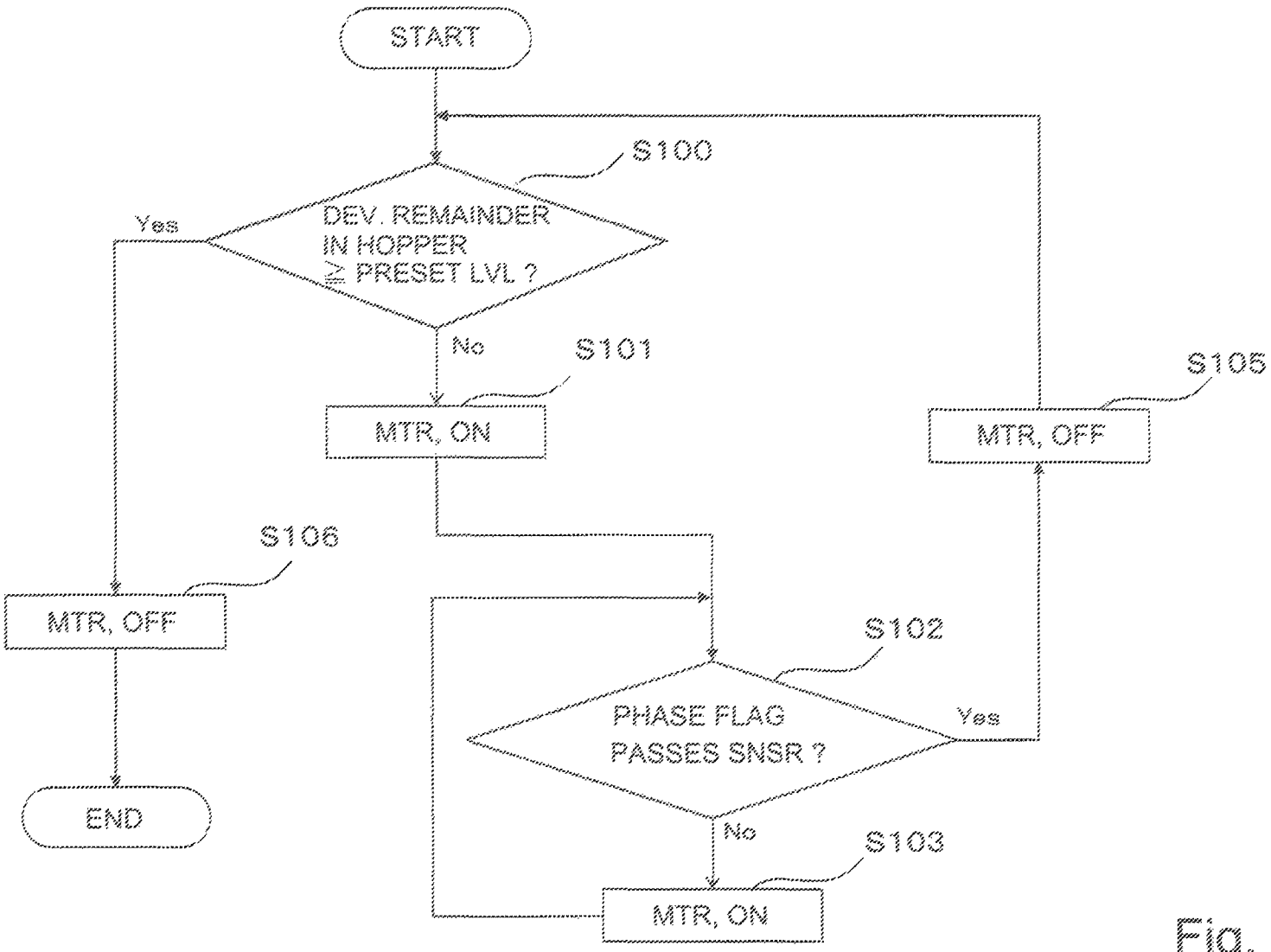

FIG. 16 is a flow chart illustrating a flow of a supplying operation in Embodiment 1 and Embodiment 2.

Figure 17:
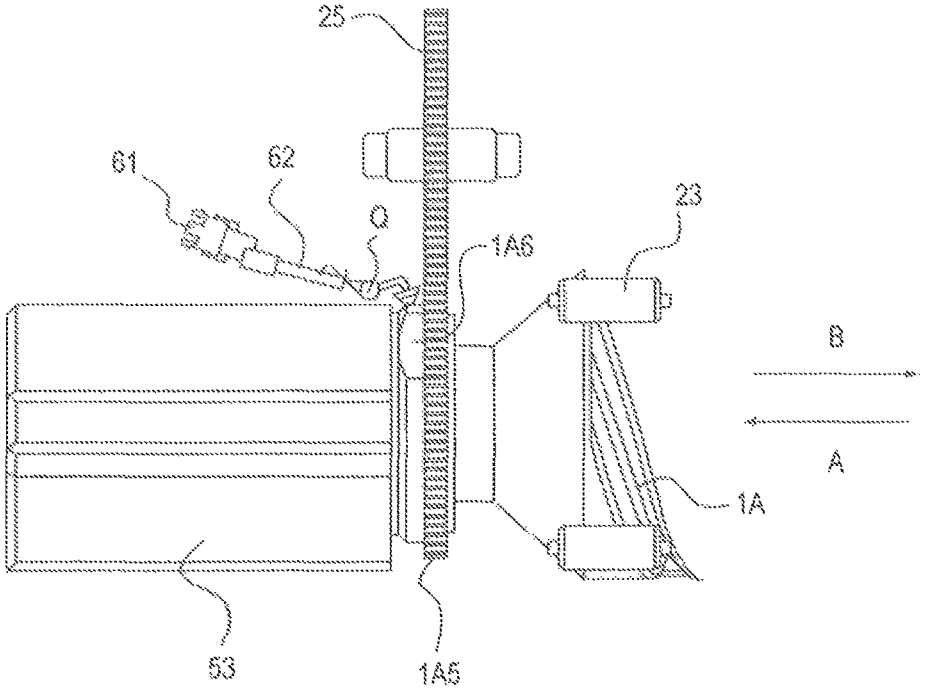

FIG. 17 is a portion enlarged view of a developer supply container according to a comparison example 1.

Figure 18:
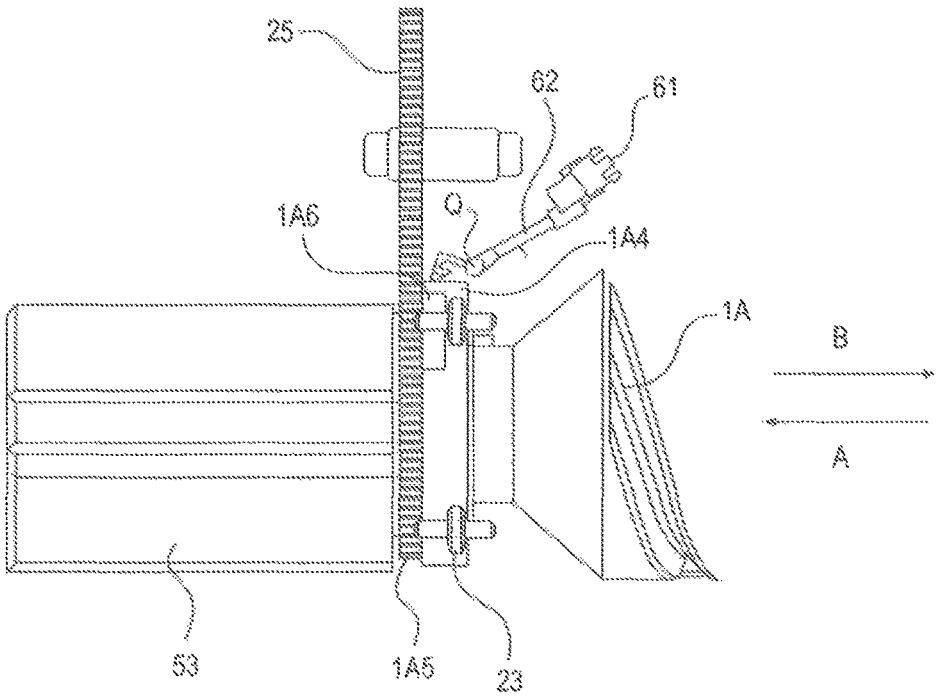

FIG. 18 is a portion enlarged view of the developer supply container according to a modified example 1.

Figure 19:
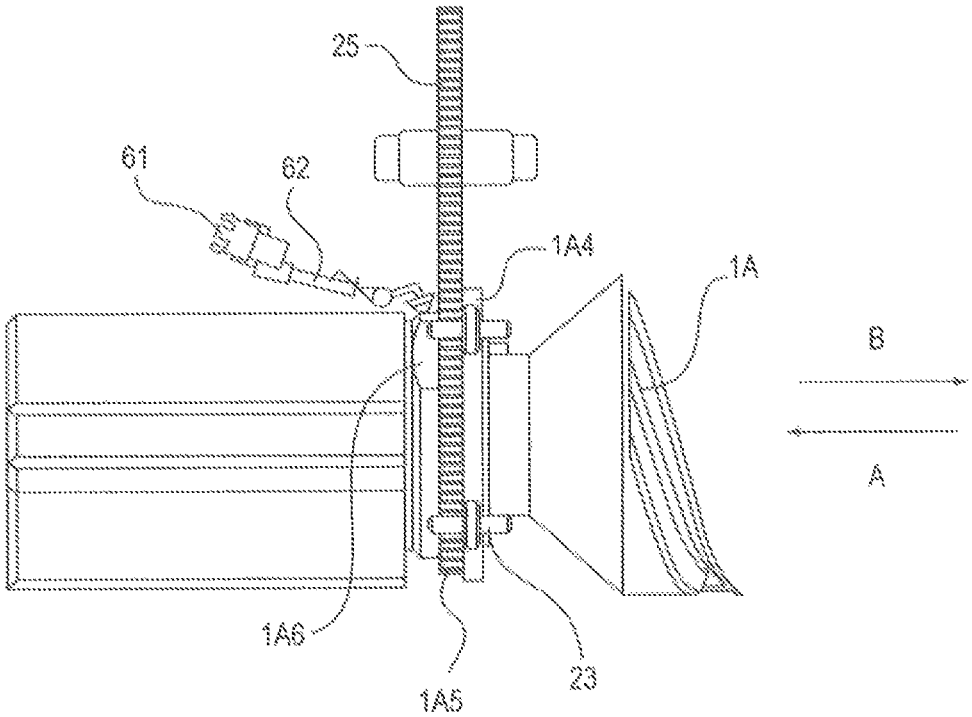

FIG. 19 is a portion enlarged view of the developer supply container according to a modified example 2.

Figure 20:
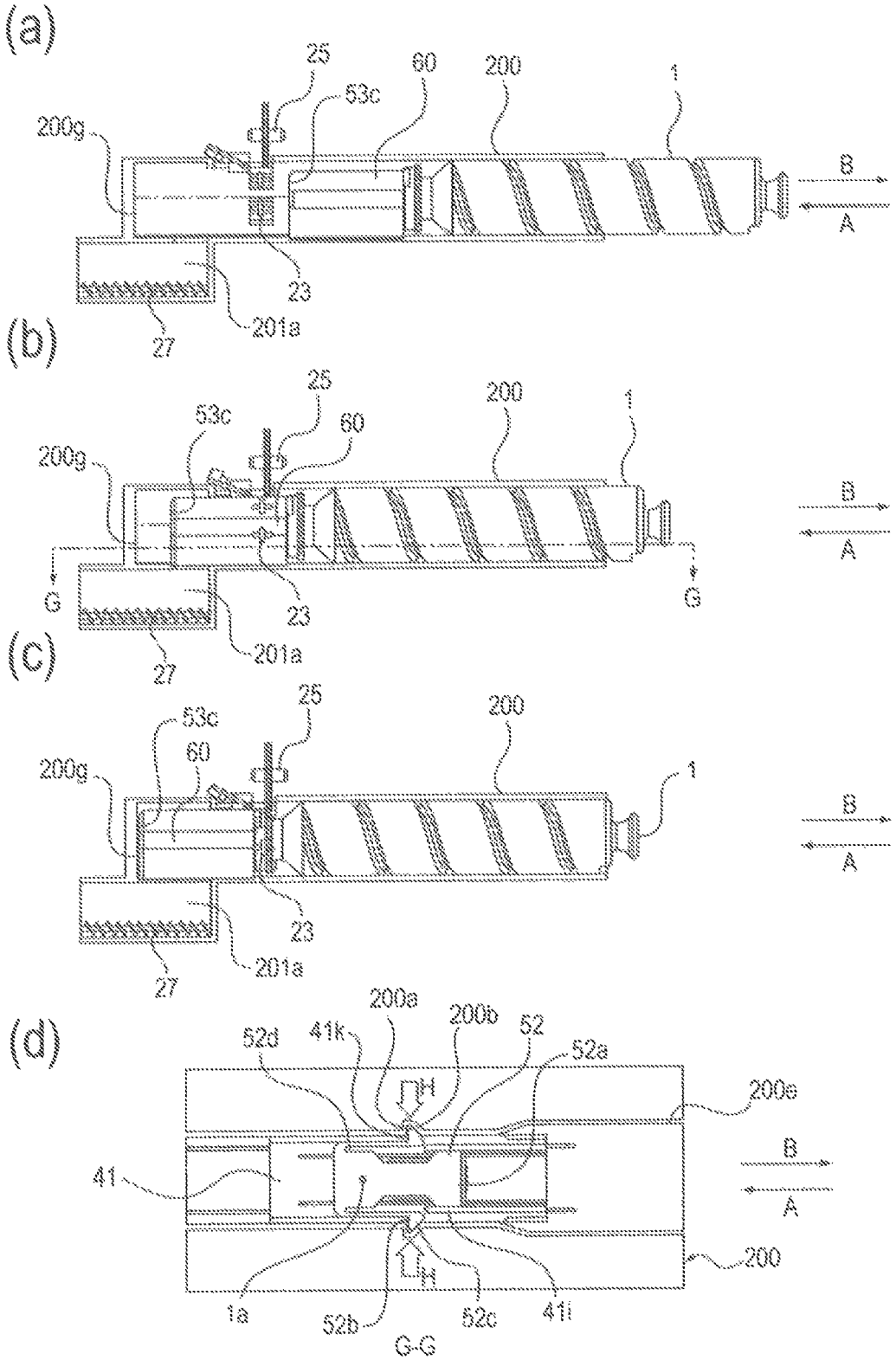

FIG. 20 is a portion enlarged view of the developer supply container according to a modified example 3.

Figure 21:
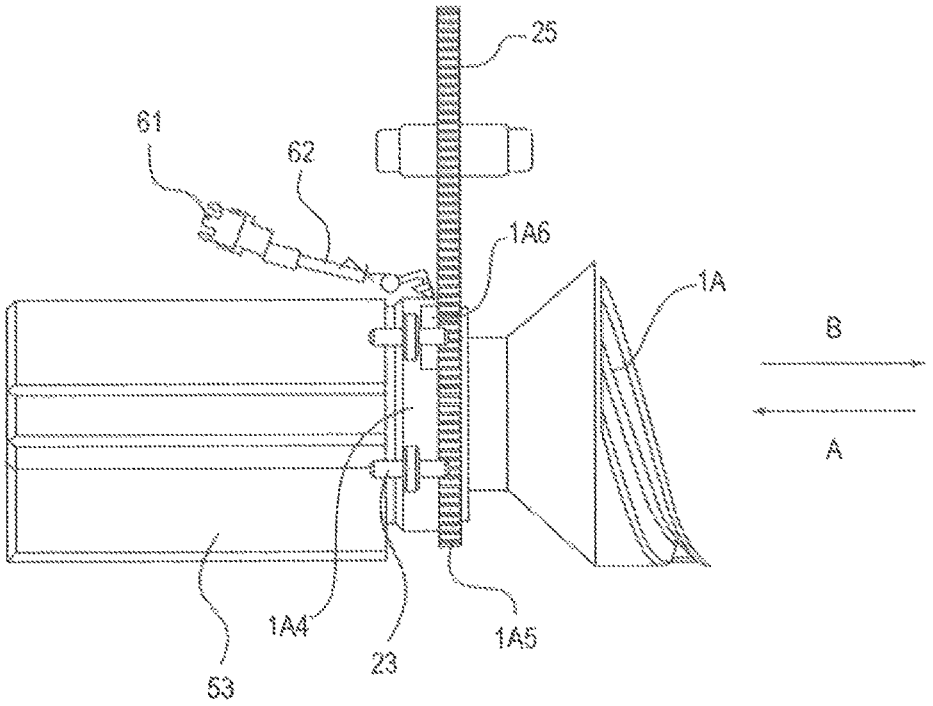

FIG. 21 is a portion enlarged view of the developer supply container according to a modified example 4.

Figure 22:
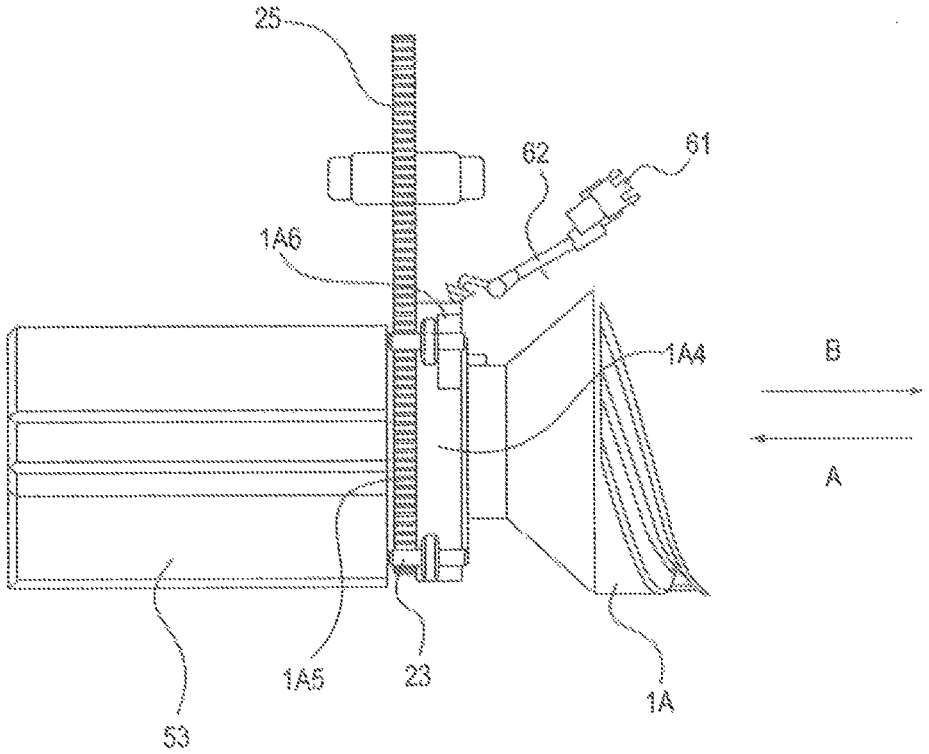

FIG. 22 is a portion enlarged view of the developer supply container according to a modified example 5.

Figure 23:
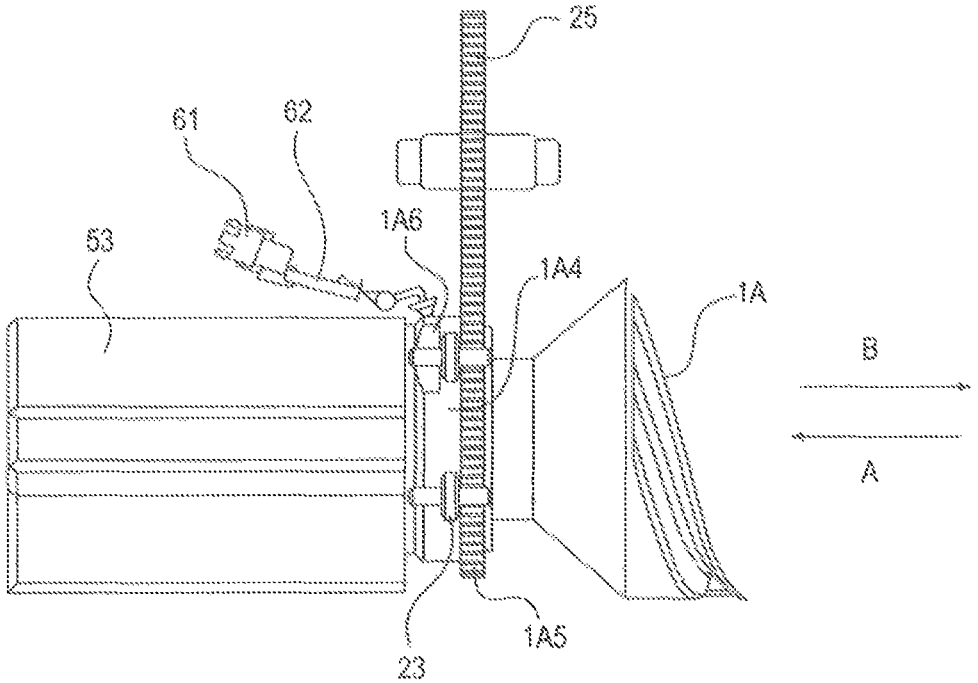

FIG. 23 is a partial enlarged view of the developer supply container according to Embodiment 1.

Figure 24:
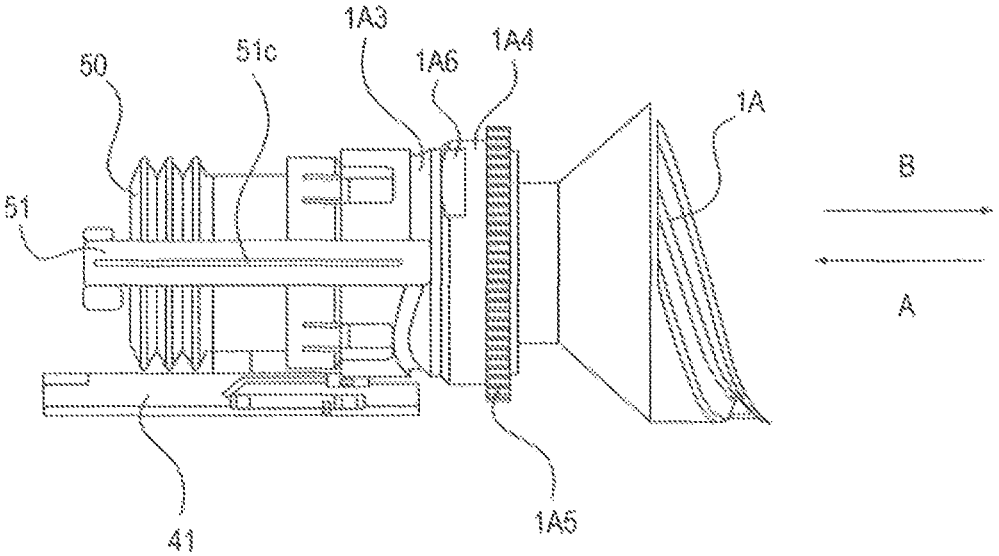

FIG. 24 is a partial enlarged view of the developer supply container with the cover omitted, according to Embodiment 1.

Figure 25:
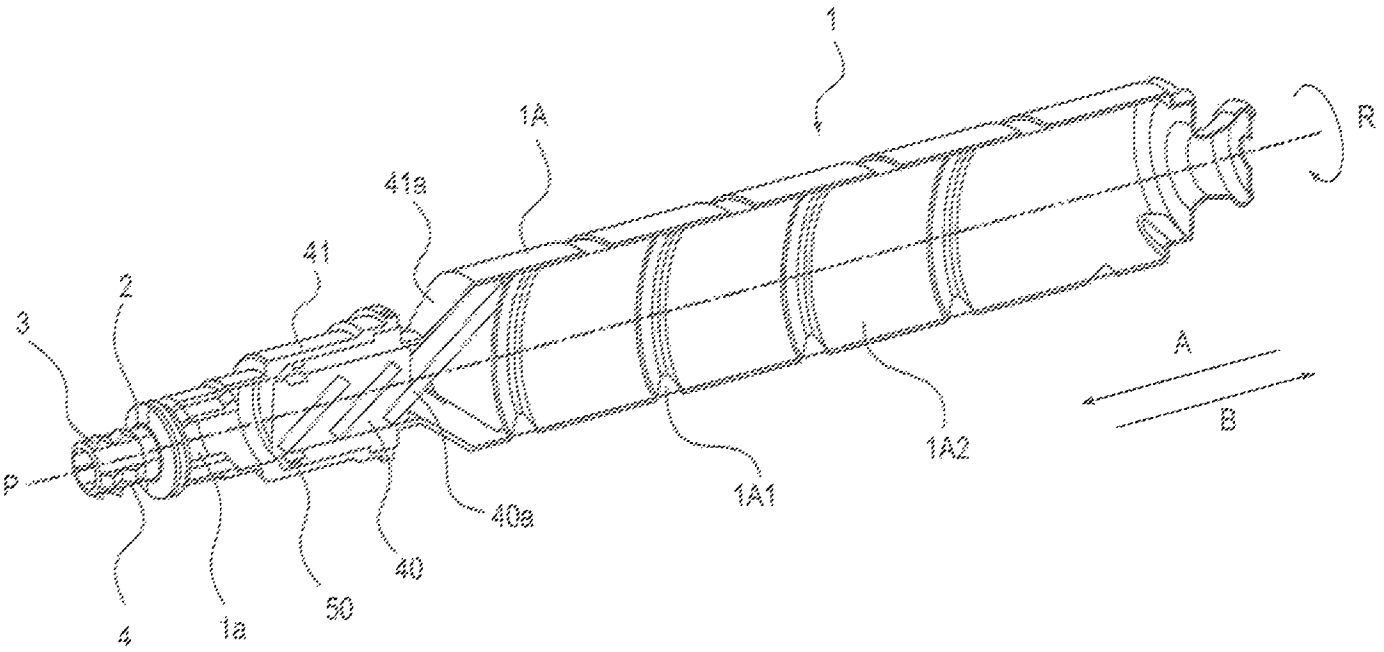

FIG. 25 is a perspective view of a section of the developer supply container according to Embodiment 2.

Figure 26:
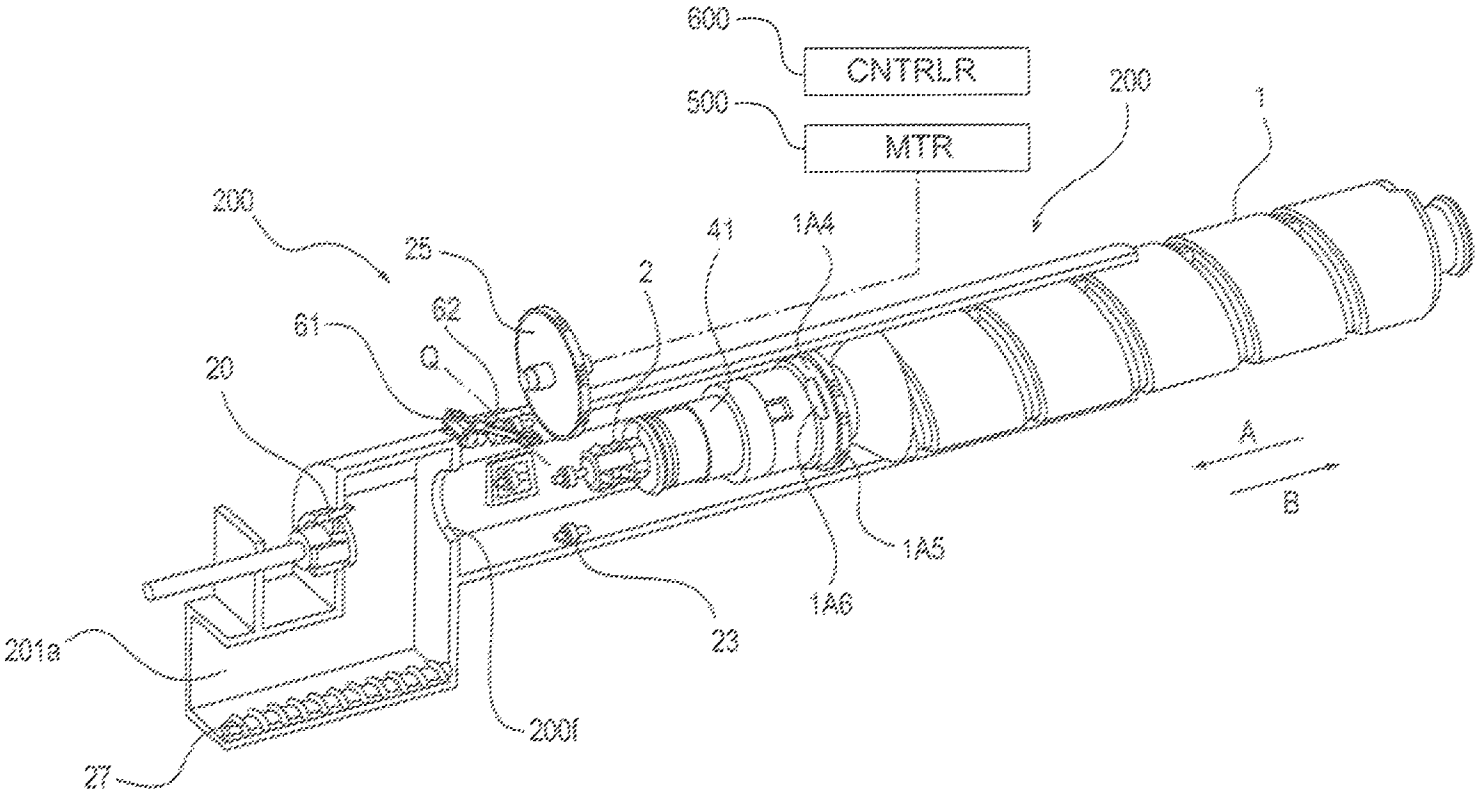

FIG. 26 is a perspective view illustrating insertion of the developer supply container into the developer receiving apparatus.

Figure 27:
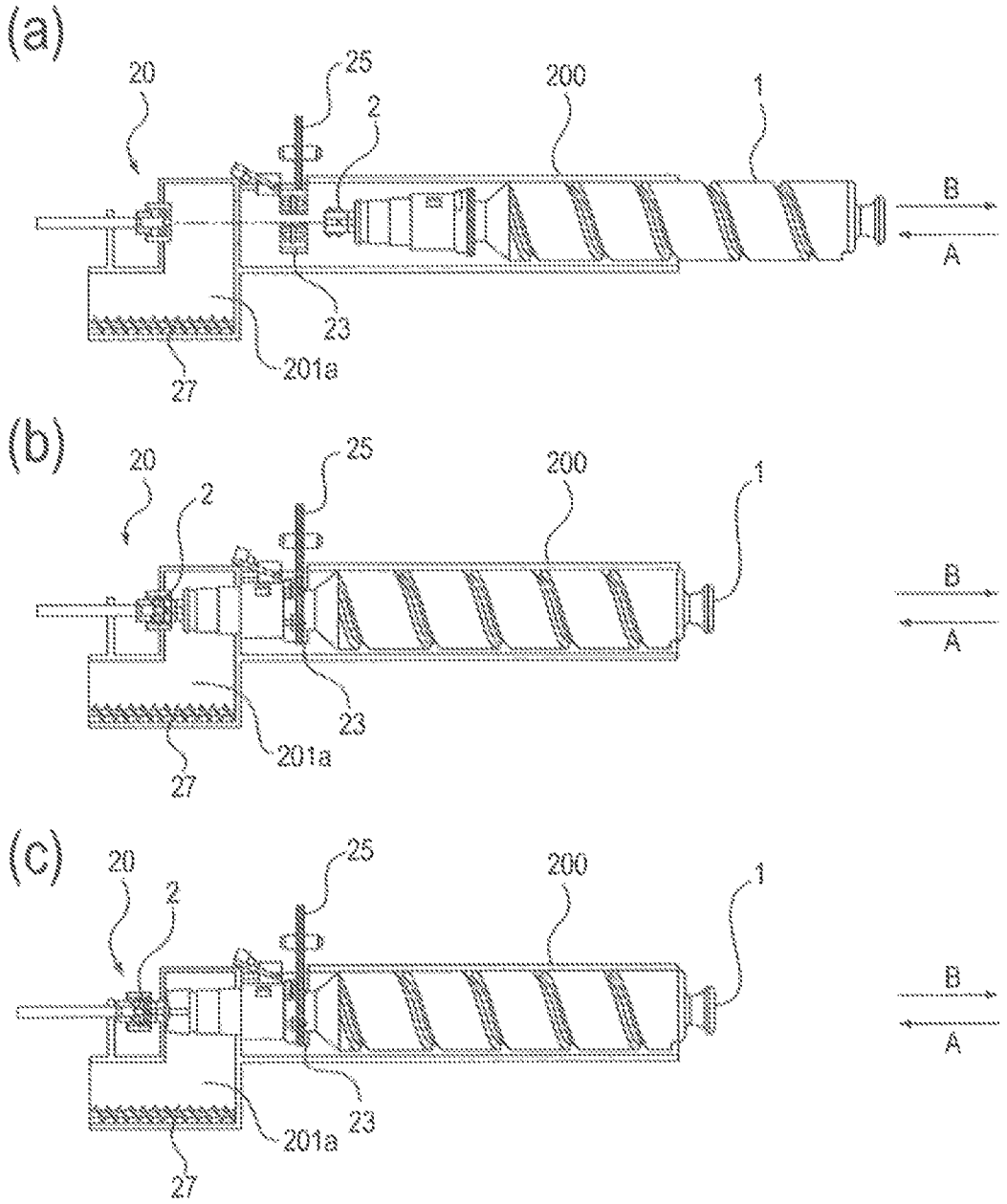

FIG. 27 is a partially sectional view illustrating steps of releasing a sealing member in the insertion of the developer supply container into the developer receiving apparatus.

Figure 28:
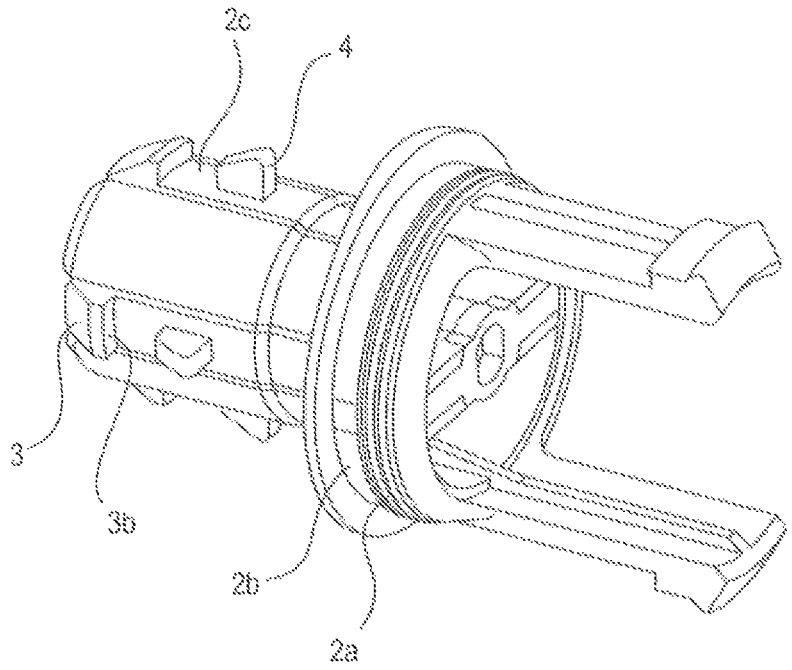
Figure 28:
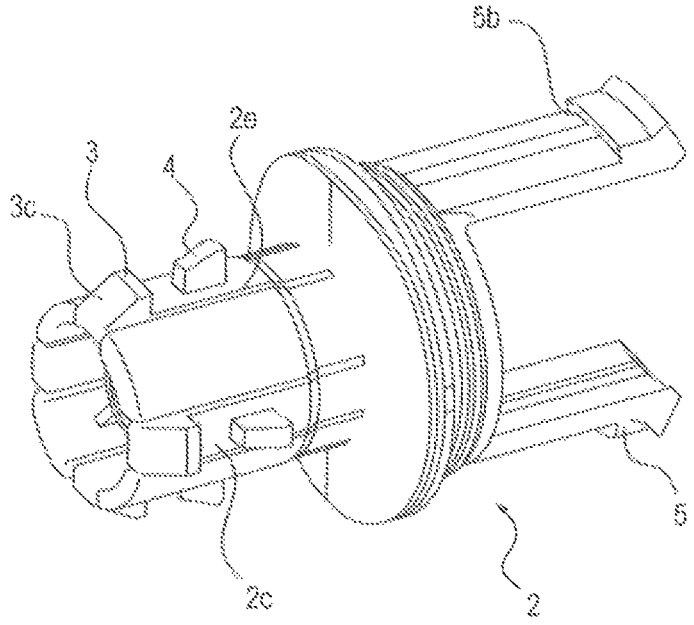

FIG. 28 is a perspective view of the sealing member in Embodiment 2.

Figure 29:
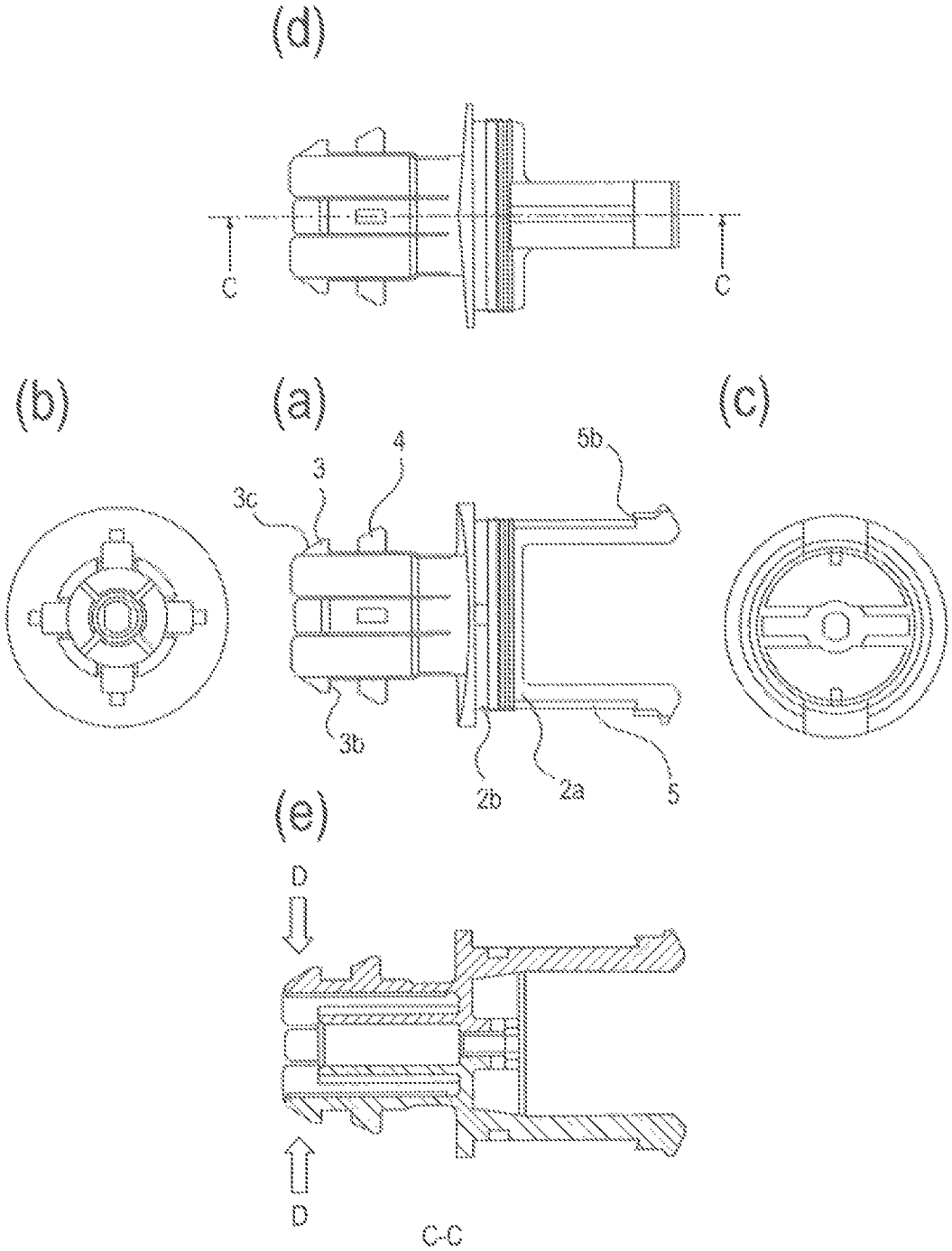

Parts (a), (b), (c), (d) and (e) of FIG. 29 are a front view, a left-hand side view, a right-hand side view, a top plan view, and a C-C sectional view of the sealing member in Embodiment 2.

Figure 30:
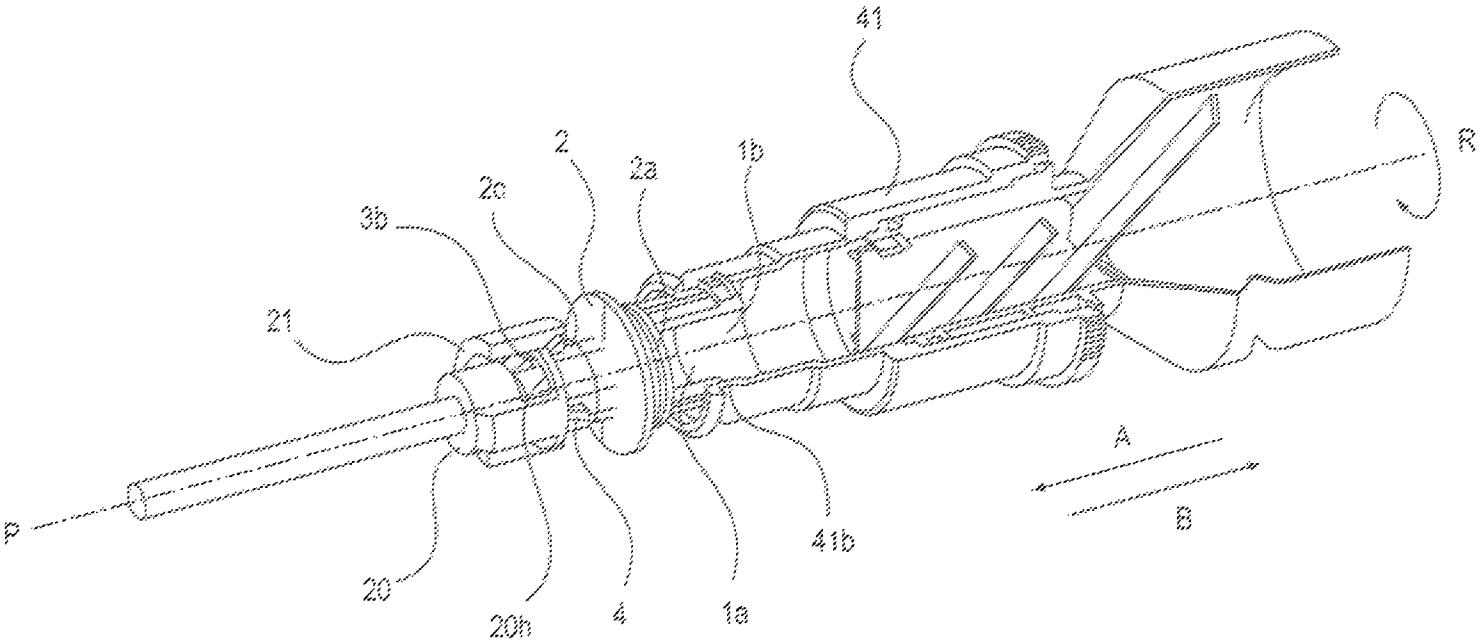

FIG. 30 is a partial perspective view of the developer supply container according to Embodiment 2.

Figure 31:
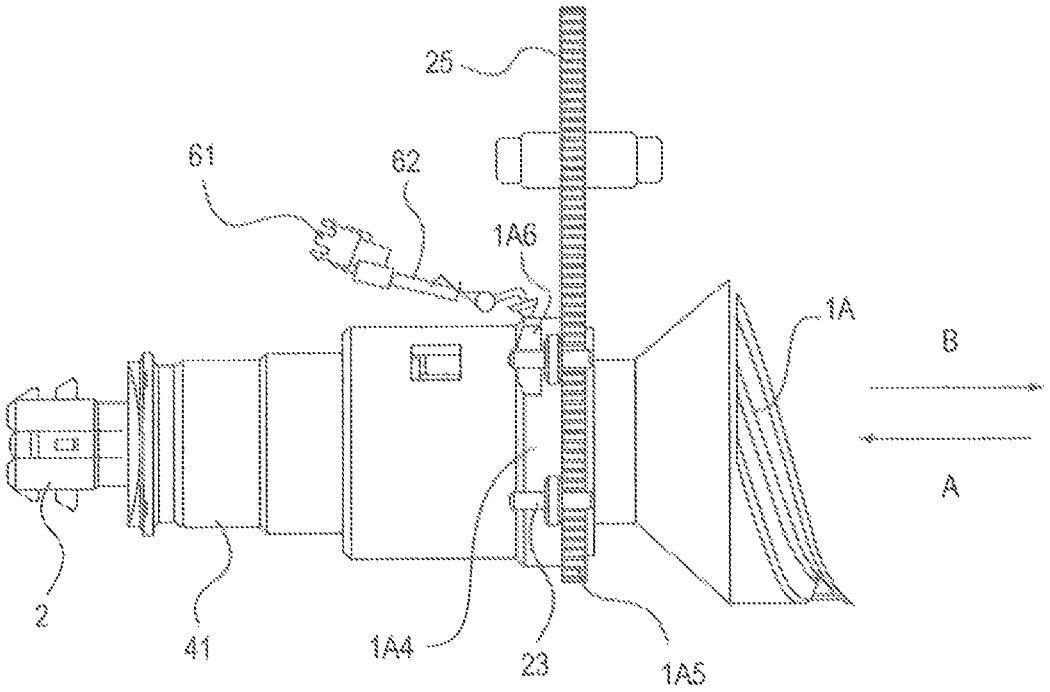

FIG. 31 is a partial enlarged view of the developer supply container according to Embodiment 2.

Figure 32:
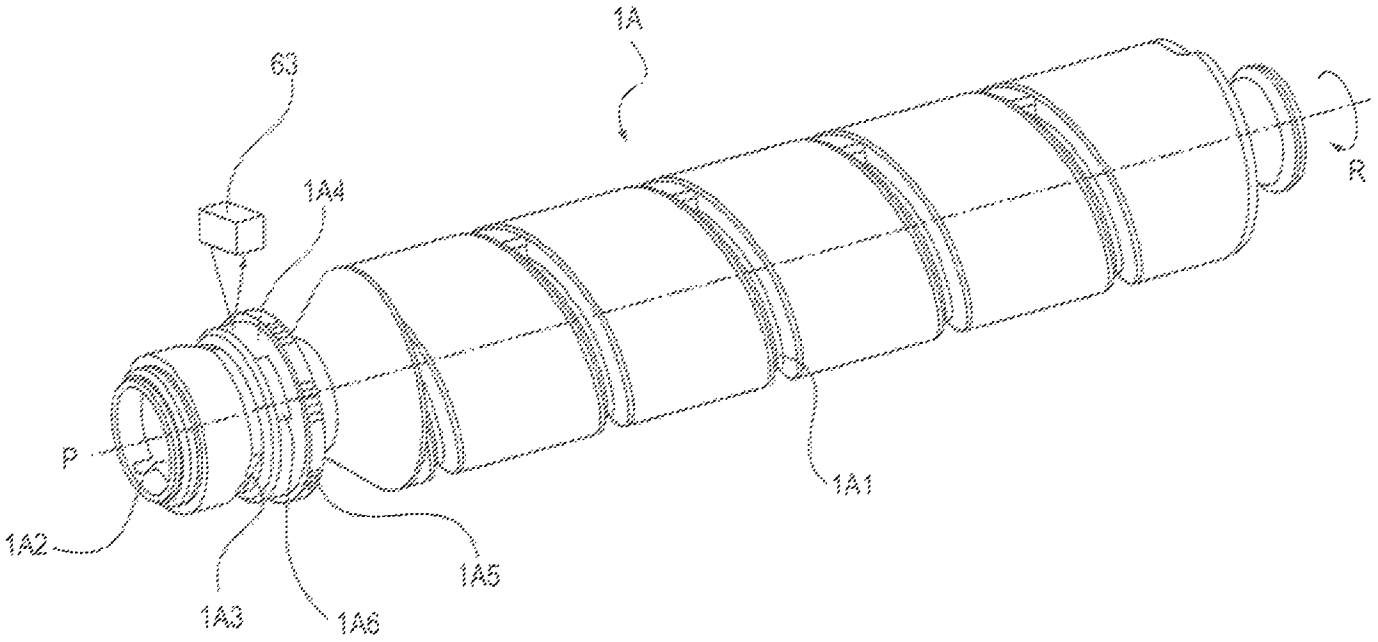

FIG. 32 is a perspective view of the developer supply container according to another embodiment of the present invention.

DESCRIPTION OF THE EMBODIMENTS

Referring to the accompanying drawings, preferable examples of the embodiments of the present invention will be described. The preferred embodiments of the present invention will be described in conjunction with the accompanying drawings. Here, the dimensions, the sizes, the materials, the configurations, the relative positional relationships of the elements in the following embodiments and examples are not restrictive to the present invention unless otherwise stated. Therefore, the scope of the present invention is not to be limited to the specific examples unless otherwise stated.

Embodiment 1

First, a basic structure of the image forming apparatus will be described, and then a developer supplying system of the image forming apparatus, that is, the structures of a developer receiving apparatus (developer supplying apparatus) and a developer supply container will be described.

(Image Forming Apparatus)

Figure 1:
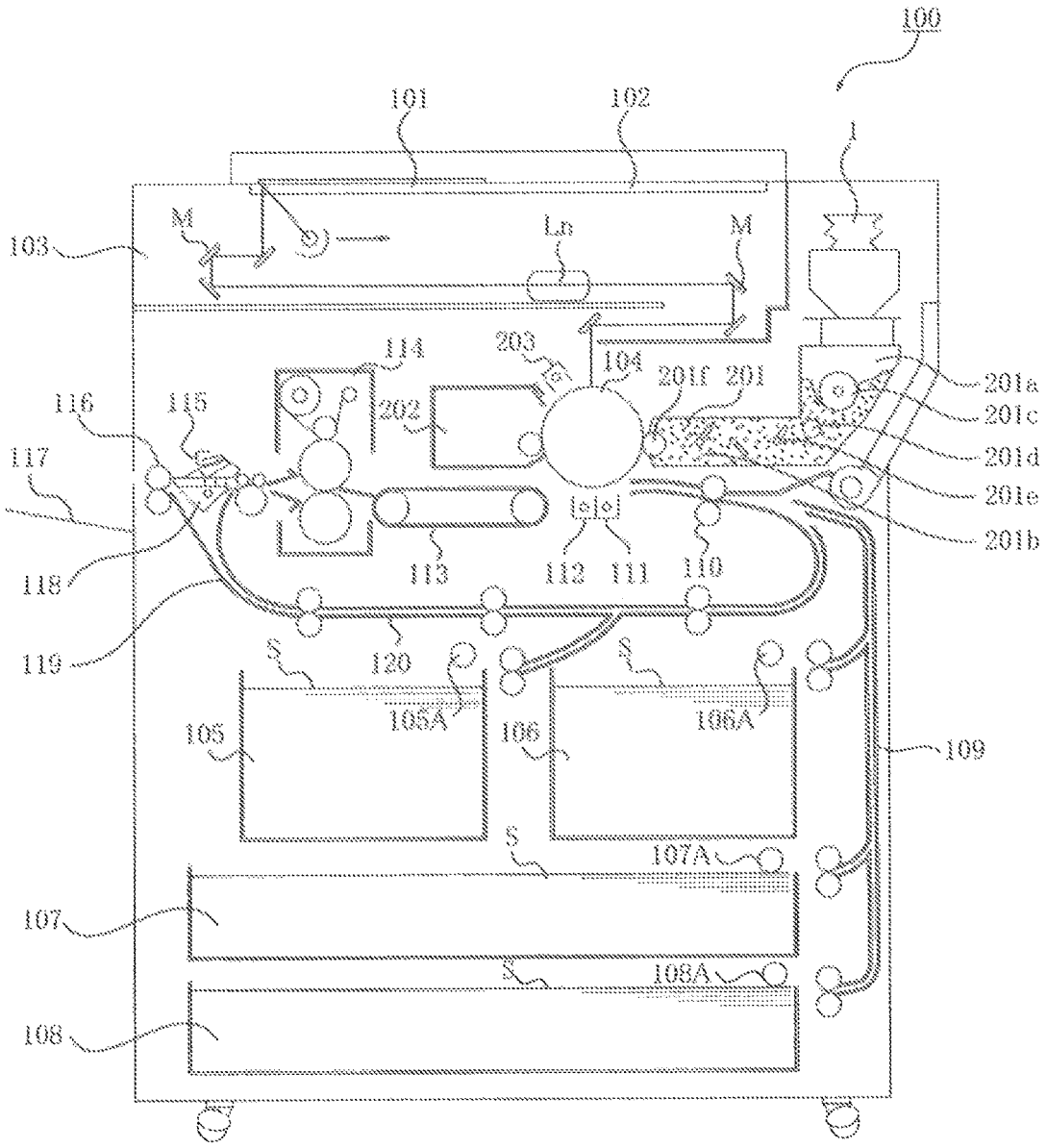
FIG. 1 is a schematic sectional view of a main assembly of the image forming apparatus (copying machine).

Referring to FIG. 1, as a example of the image forming apparatus comprising a developer receiving apparatus to which the developer supply container (so-called toner cartridge) is detachably mountable, a copying machine (electrophotographic image forming apparatus of a electrophotographic type will be described.

In FIG. 1, designated by reference numeral 100 is a main assembly of the copying machine (main assembly of the image forming apparatus or simply main assembly). Designated by 101 is an original placed on an original supporting platen glass 102. A light image corresponding to the image information of the original is imaged and focused on an electrophotographic photosensitive member (photosensitive drum) 104 through a plurality of mirrors M and a lens Ln of an optical portion 103 so that an electrostatic latent image is formed. The electrostatic latent image is visualized into the toner image with a developer by the developing device 201*b*.

The submitted by 105-108 is a cassette for accommodating recording material (sheets) S. A proper one of the cassettes is selected from the cassettes cassette 105-108 corresponding to information inputted by the operator (user) in an operating portion 100*a* of the copying machine shown in FIG. 2 or the sheet size of the original 101. The recording material is not limited to sheets of paper, but may be OHP sheet or the like, for example.

One sheet S fed by a feeding and separating devices 105A-108A is fed to registration rollers 110 by way of a feeding portion 109, and is then fed at a timing in synchronism with the rotation of the photosensitive drum 104 and the scanning of the optical portion 103.

The designated by 111, 112 are a transfer charger, and a separation charger. Here, the image of the developer formed on the photosensitive drum 104 is transferred onto the sheet S by a transfer charger 111. The sheet S carrying the transferred developer image (toner image) is separated from the photosensitive drum 104 by the separation charger 112.

Thereafter, the sheet S fed by the feeding portion 113 is subjected to heat and pressure in a fixing portion 114, by which the developer image is fixed on the sheet, and thereafter, in the case of a one-sided copy, the sheet is passed through a discharging/reversing portion 115 and is discharged onto a discharging tray 117 by discharging rollers 116.

In the case of a duplex copy, the sheet S is passed through the discharging/reversing portion 115, and a part of the sheet S is once discharged to the outside of the apparatus by the discharging rollers 116. Then, a flapper 118 is controlled at the timing when the trailing end of the sheet S passed through the flapper 118 while the sheet S is still nipped by the discharging rollers 116, and the discharging rollers 116 are rotated in the opposite direction to re-feed the sheet S into the apparatus. Thereafter, the sheet is fed to the registration rollers 110 by the way of a re-feeding portion 119, 120, and is subjected to the image forming operation similarly to the case of the one-sided copy, and is discharged onto the discharging tray 117.

In the case of a superimposed copy, the sheet S is passed through the discharging/reversing portion 115, and a part of the sheet S is once discharged to the outside of the apparatus by the discharging rollers 116. Then, a flapper 118 is controlled at the timing when the trailing end of the sheet S passed through the flapper 118 while the sheet S is still nipped by the discharging rollers 116, and the discharging rollers 116 are rotated in the opposite direction to re-feed the sheet S into the main assembly 100. Thereafter, the sheet is fed to the registration rollers 110 by the way of a re-feeding portion 119, 120, and is subjected to the image forming operation similarly to the case of the one-sided copy, and is discharged onto the discharging tray 117.

Around the photosensitive drum 104 in the main assembly A 100, there are provided image forming process equipment (process means) including a developing device 201 as developing means, a cleaning device 202 as cleaning means, a primary charger 203 as charging means and so on. The developing device 201 develops, with the developer (toner), the electrostatic latent image formed by the exposing the uniformly charged photosensitive drum 104 to the light on the basis of the image information of the original 101 by optical portion 103. A developer supply container 1 for supplying the toner as the developer into the developing device 201 is detachably mounted to the main assembly 100 by the user. The present invention is applicable to the case in which only the toner is supplied from the developer supply container 1 into the image forming apparatus side, or to the case in which the toner and carrier are supplied. In the following description, the former case is taken.

The developing device 201 comprises a developer hopper portion 201*a* as accommodating means and a developing device 201*b*. The developer hopper portion 201*a* is provided with a stirring member 201*c* for stirring the developer supplied from the developer supply container 1. The developer stirred by the stirring member 201*c* is fed into the developing device 201*b* by a magnet roller 201*d*. The developing device 201*b* includes a developing roller 201*f* and a feeding member 201*e*. The developer fed from the developer hopper portion 201*a* by the magnet roller 201*d* is supplied to the developing roller 201*f* by the feeding member 201*e*, and is and supplied onto the photosensitive drum 104 by the developing roller 201*f*. The cleaning device 202 is provided to remove the residual developer remaining on the photosensitive drum 104. The primary charger 203 functions to uniformly charge the surface of the photosensitive drum 104 to form a desired electrostatic image on the photosensitive drum 104.

Figure 2:
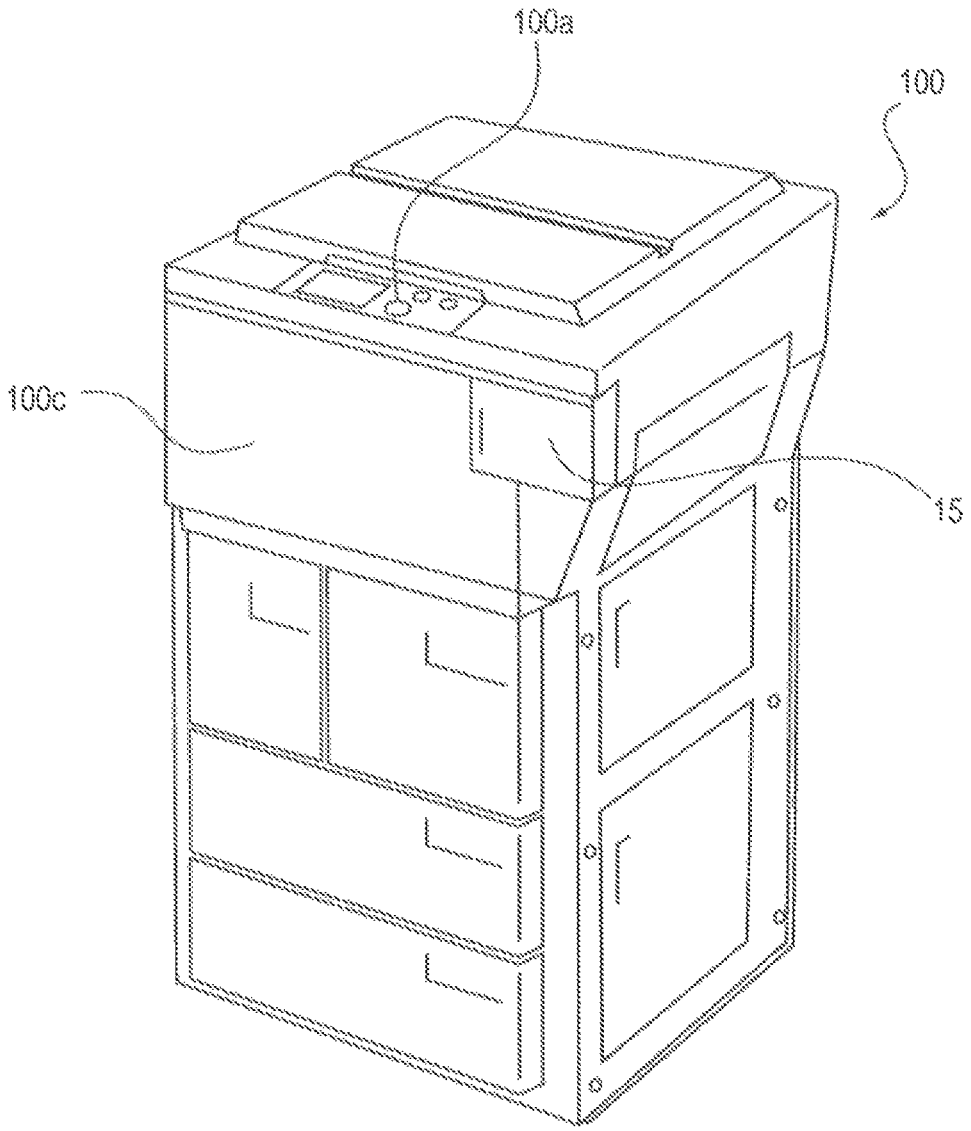
FIG. 2 is a perspective view of the main assembly of the image forming apparatus.

When the user opens a developer supply container exchange front cover 15 (exchange front cover) which is a part of an outer casing shown in FIG. 2, a container supporting tray 50 which is a part of mounting means is drawn out to a predetermined position by a drive system (unshown). The developer supply container 1 is placed on the container supporting tray 50. When the user is to remove the developer supply container 1 from the main assembly 100, the container supporting tray 50 is drawn out, and the developer supply container 1 is taken out of the container supporting tray 50. Here, the exchange front cover 15 is exclusively for mounting and demounting (exchanging) of the developer supply container 1, and is opened and closed only when the developer supply container 1 is mounted or dismounted. For the maintenance operation of the main assembly 100, a front cover 100*c* is opened. The developer supply container 1 may be directly mounted to or dismounted from the main assembly 100 without using the container supporting tray 50.

(Developer Receiving Apparatus)

Figure 4:
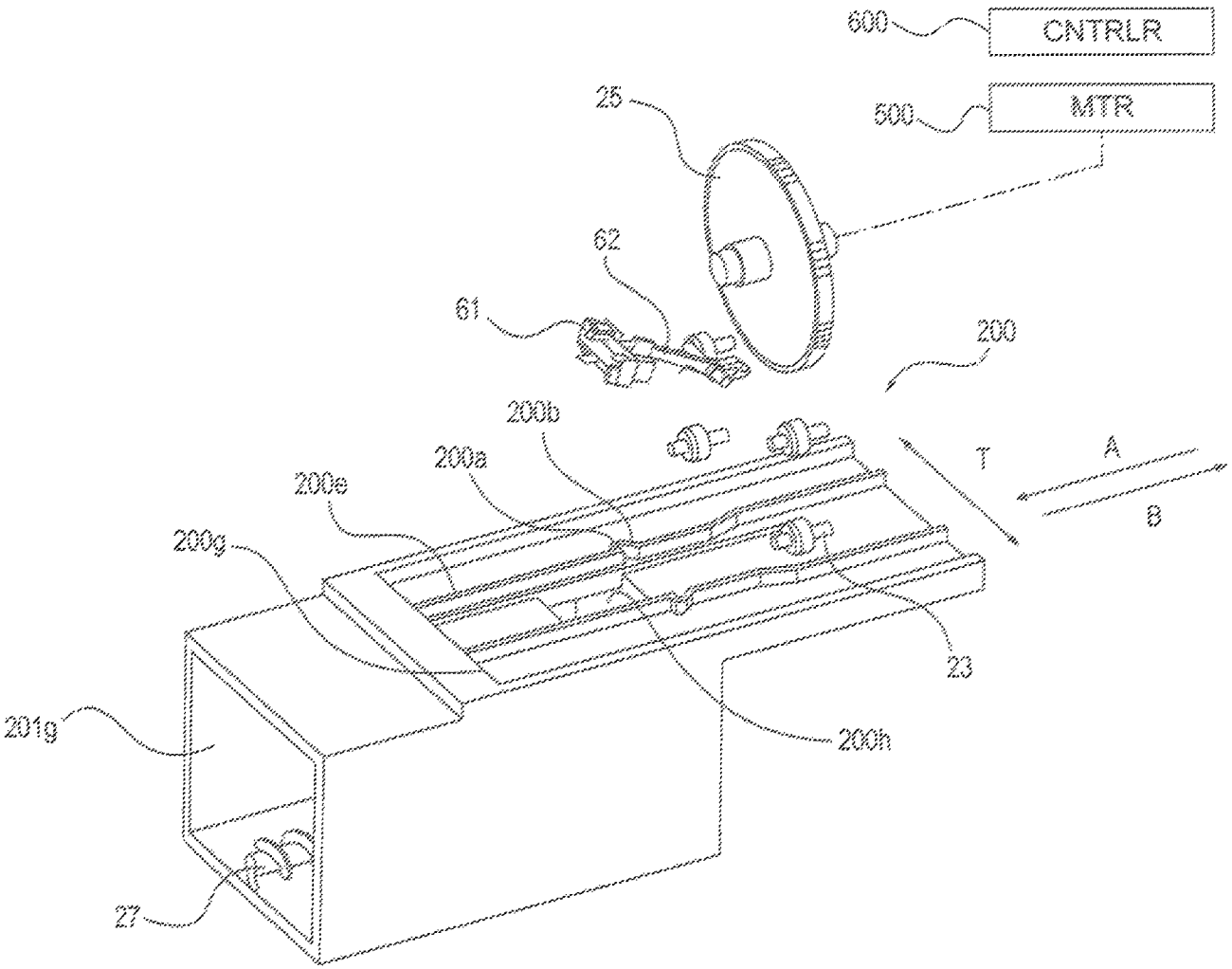
FIG. 4 is a partial perspective view of a developer receiving apparatus according to Embodiment 1 of the present invention.

Referring to FIG. 4, the structure of the developer receiving apparatus (developer supplying apparatus) will be described. FIG. 4 is a portion perspective view of the developer receiving apparatus 200 according to Embodiment 1.

As shown in FIG. 4, the developer receiving apparatus 200 mainly includes a bottle receiving roller 23 contactable to a rotation fluctuation regulating portion 1A4 of the developer supply container 1 which will be described hereinafter, a driving gear 25 for transmitting a rotational force to a drive receiving portion 1A5 of the developer supply container 1. The developer receiving apparatus 200 further includes a phase detection flag 62 for detecting a phase (rotation) of the developer supply container 1 by being contacted by a phase detecting portion (portion-to-be-detected) 1A6 of the developer supply container 1, and a phase sensor 61 for detecting phase detection flag 62. The phase detection flag 62 is urged downwardly by an elastic member (unshown) and is rotatable about a rotational axis Q (FIG. 17).

The developer receiving apparatus 200 includes the developer hopper portion 201*a* for temporarily storing the developer discharged from the developer supply container 1, a developer hopper communicating portion 200*h* in fluid communication with the developer hopper portion 201*a*, a screw member 27 for feeding the developer from the developer hopper portion 201*a* into the developing device 201 (FIG. 1). In addition, the developer receiving apparatus 200 includes a cover abutting portion 200 *g* to be contacted by a developer receiving apparatus abutting portion 53*c* of a cover 53 (part (a) of FIG. 13) of the developer supply container 1, an insertion guide 200*e* for regulating displacement of the developer supply container 1 in the direction indicated by an arrow T by contacting to the guide groove 53*a* of the cover 53 when the developer supply container 1 is inserted into the developer receiving apparatus 200, and a shutter stopper portion 200*a* (200*b*) engaged with a stopper portion 52*b* (52*c*) of a shutter 52 (part (a) of FIG. 10).

(Developer Supply Container)

Figure 6:
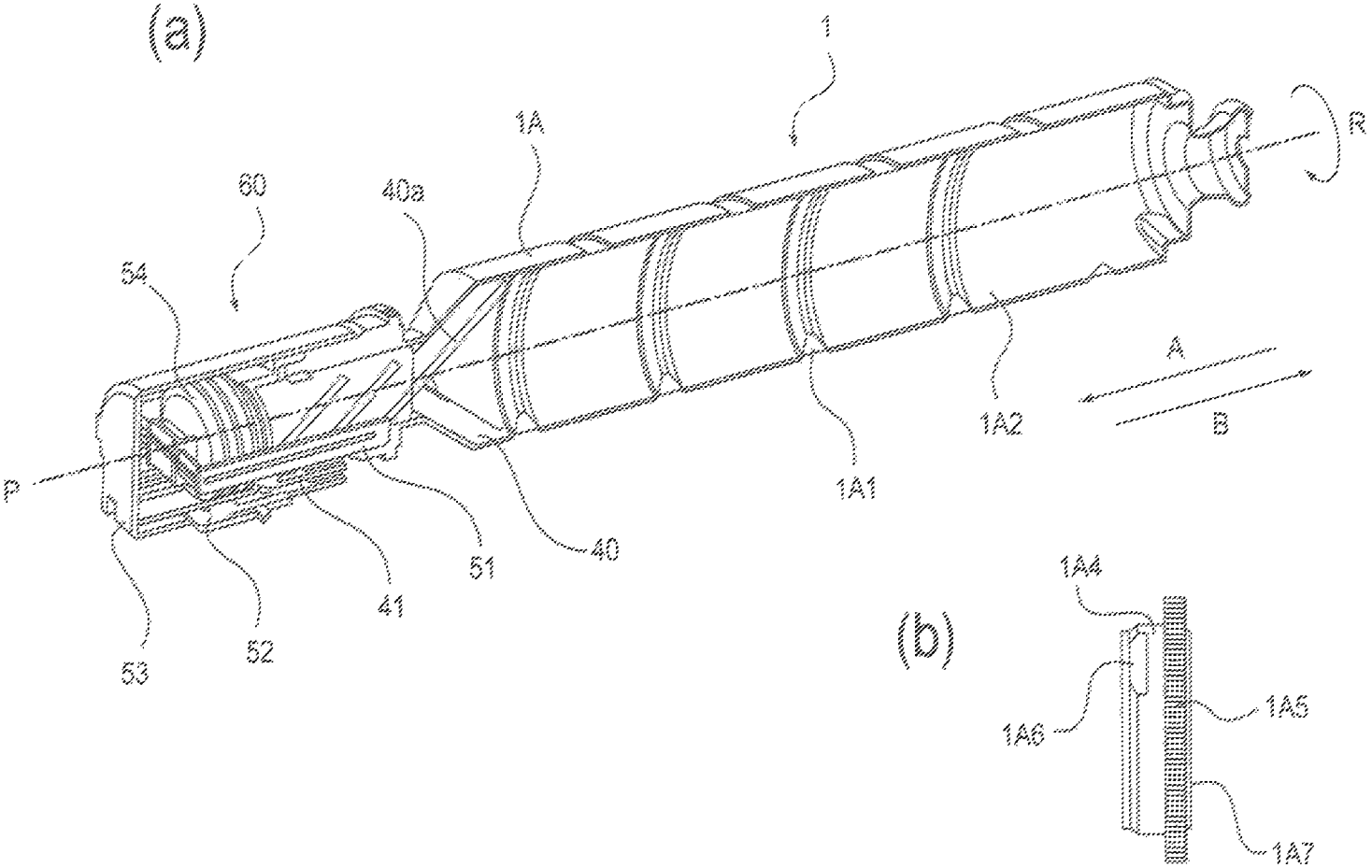
FIG. 6 is a perspective view of a section of the developer supply container according to Embodiment 1.

Referring to FIG. 6, the developer supply container 1 will be described. FIG. 6 is a perspective view of a section of the developer supply container 1.

As shown in FIG. 6, the developer supply container 1 mainly includes a container body 1A, a flange portion 41, the shutter 52, a pump portion 54, a reciprocating member 51 and the cover 53. The developer supply container 1 supplies the developer from the developer supply container 1 into the developer hopper portion 201*a* (FIG. 5) by developer supply means which will be described hereinafter. The elements constituting the developer supply container 1 will be described in detail.

(Container Body)

Figure 7:
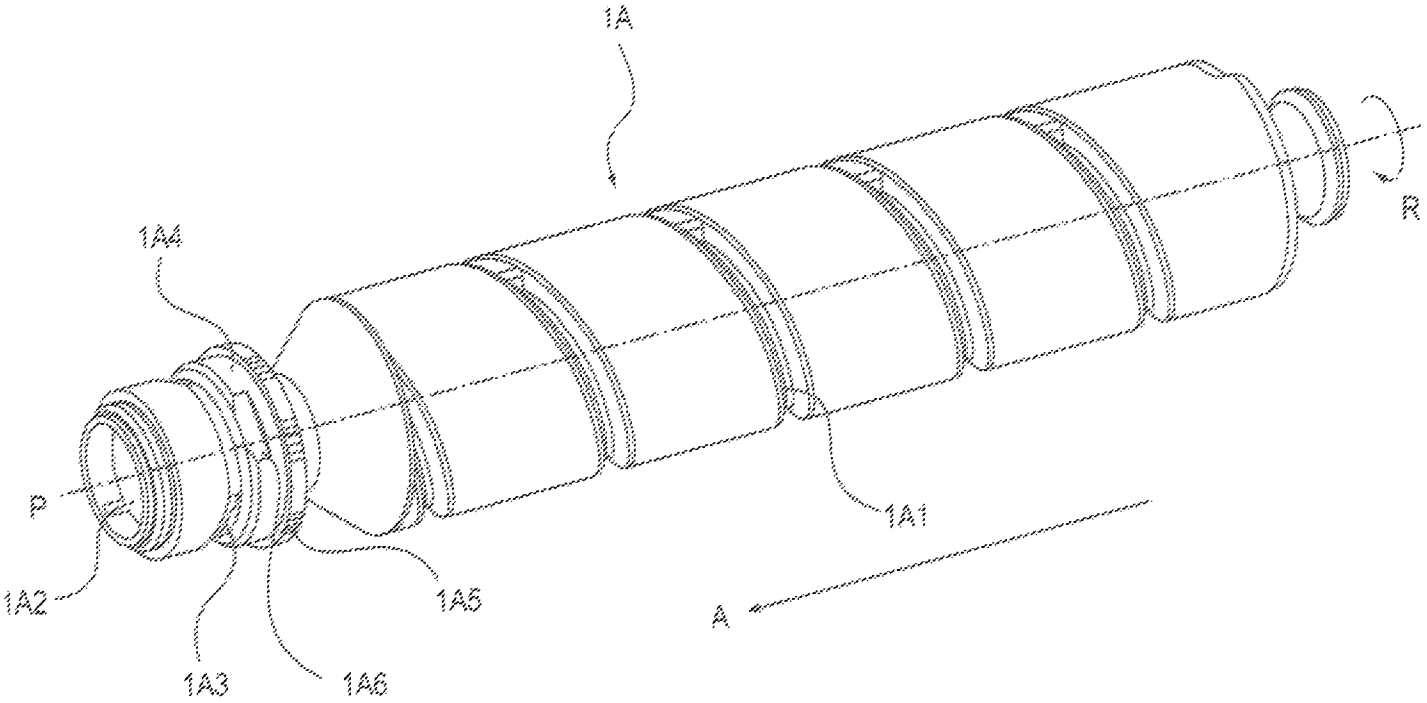
FIG. 7 is a perspective view of a container body in Embodiment 1.

Referring to FIG. 7, the container body 1A will be described. FIG. 7 is a perspective view of the container body 1A.

The container body 1A includes a developer accommodating portion 1A2 for accommodating the developer therein, and a helical projection (developer feeding portion) 1A1 for feeding the developer in the developer accommodating portion 1A2 in a direction indicated by an arrow A (FIG. 6) by the rotation of the container body 1A about an axis P in the direction indicated by an arrow R.

The container body 1A father includes the drive receiving portion 1A5 for receiving the rotational force from the driving gear 25 of the developer receiving apparatus 200, and a phase detecting portion 1A6 for detecting the phase of the accommodating portion 1A2 which is rotated by the rotational force applied to the drive receiving portion 1A5. In addition, the container body 1A includes a rotation fluctuation regulating portion 1A4 four suppressing fluctuation of rotation of the phase detecting portion 1A6 and the drive receiving portion 1A5 when the accommodating portion 1A2 rotates. In addition, the container body 1A of this embodiment is provided with a cam groove 1A3 as is different from the container of Embodiment 2 which will be described hereinafter. In this embodiment, the rotation fluctuation regulating portion 1A4, the drive receiving portion 1A5 and the phase detecting portion 1A6 are integral with the container body 1A. Part (b) of FIG. 6 illustrates the structure. In this embodiment, one resin material (drive receiving part in this embodiment) of plastic resin material or the like is provided with a phase detecting portion 1A6 and a rotation fluctuation regulating portion 1A4 for suppressing the fluctuation of rotation of the drive receiving portion 1A5. A drive transmitting portion 1A7 provided at an end portion of the drive receiving part is connected with the developer accommodating portion 1A2. By the integral rotation of the drive transmitting portion 1A7 and the developer accommodating portion 1A2, the driving force received by the drive receiving portion 1A5 is transmitted to the developer accommodating portion 1A2. As a result, the feeding portion for feeding the toner is rotatable.

In this embodiment, the rotation fluctuation regulating portion 1A4, the drive receiving portion 1A5 and the phase detecting portion 1A6 are integral with the container body 1A (part (b) of FIG. 6), but this structure is not inevitable. For example, the cam groove 1A3, the rotation fluctuation regulating portion 1A4, the drive receiving portion 1A5 and the phase detecting portion 1A6 may be formed integrally and may be integrally mounted to the container body 1A.

The accommodating portion 1A2 is a combination of the container body 1A plus inside spaces of the flange portion 41 (FIG. 8) and the pump portion 54 (FIG. 11).

In this embodiment, the phase detecting portion 1A6 is recessed from the rotation fluctuation regulating portion 1A4, but it may be projected from the rotation fluctuation regulating portion 1A4.

In this embodiment, a circularity of the rotation fluctuation regulating portion 1A4 is 0.05 to improve play preventing effect, in the radial direction, of the drive receiving portion 1A5 and the phase detecting portion 1A6 when the developer is supplied by the rotation of the developer supply container 1 in the R direction (FIG. 6). The circularity of the rotation fluctuation regulating portion 1A4 is preferably high since then the radial play preventing effect is high, but high circularity leads to high cost, and 0.05 of the circularity it is selected as a not unnecessarily high geometrical tolerance. As described, the rotation fluctuation regulating portion is cylindrical.

With such a structure, the fluctuations of rotations of the phase detecting portion 1A6 and the drive receiving portion 1A5 can be suppressed by the contact between the rotation fluctuation regulating portion 1A4 which is close to a true circle and the bottle receiving rollers (rotatable members) when the developer supply container 1 rotates in the arrow R direction of FIG. 6. In this manner, the rotation fluctuation regulating portion functions as a contact for contacting the rotatable member. As a result, the accuracies of both of the drive transmission and the phase detection are expected. Furthermore, the vibration resulting from the rotation of the developer supply container 1 can be reduced, and therefore, the improvement in the image quality is expected.

In the drive receiving part, the drive receiving portion 1A5 and the phase detecting portion 1A6 are provided adjacent to the rotation fluctuation regulating portion 1A4. With such a structure, the rotation fluctuations of both of the phase detecting portion 1A6 and the drive receiving portion 1A5 can be suppressed as compared with the structure in which the drive receiving portion 1A5 and the phase detecting portion 1A are disposed away from each other. As a result, the accuracies of the drive transmission and the phase detection are improved, and the image quality is also improved.

(Baffle Member)

Referring to FIG. 6, a baffle member 40 will be described. FIG. 6 is a partially sectional perspective view of the developer supply container 1 of Embodiment 1.

The baffle member 40 of Embodiment 1 is different from that of Embodiment 2 in the portion finally feeding the developer. More particularly, the structure of this embodiment is different from that of in that the developer is fed into a storage portion 41*f* (part (b) of FIG. 9) wild sliding down on the inclined projection 40*a* with the rotation of the baffle member 40.

(Flange Unit Portion)

Referring to FIG. 6, a flange unit portion 60 will be described. FIG. 6 is a perspective view of a section of the developer supply container 1.

As shown in FIG. 6, the flange unit portion 60 includes the flange portion 41, the reciprocating member 51, the pump portion 54, the cover 53 and the shutter 52.

The flange unit portion 60 is rotatably relative to the container body 1A, and when the developer supply container 1 is mounted to the developer receiving apparatus 200, the flange unit portion 60 is held by the developer receiving apparatus 200 in the state that the flange unit portion 60 is not rotatable about the axis P. One end portion of the flange portion 41 is connected with a pump portion 54 by screwing, and the other end portion is connected with the container body 1A through a sealing member (unshown). The reciprocating member 51 sandwiches the pump portion 54 in the thrust direction, and engaging projections 51*b* (part (a) of FIG. 12) provided on the reciprocating member 51 are engaged with the cam grooves 1A3 (FIG. 7) of the container body 1A. In addition, the shutter 52 (FIG. 10) is assembled in a shutter inserting portion 41*c* (part (a) of FIG. 8) of the flange portion 41. The cover 53 (FIG. 13) is provided to prevent the user from touching the developer supply container 1 and therefore from unexpected damage and to protect the reciprocating member 51 and the pump portion 54.

(Flange Portion).

Figure 8:
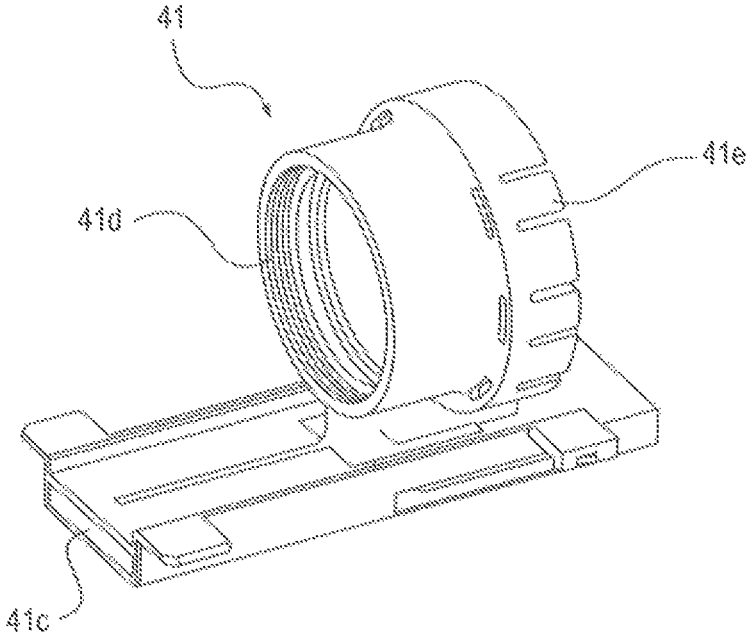
FIG. 8 is a perspective view of a flange portion in Embodiment 1.
Figure 8:
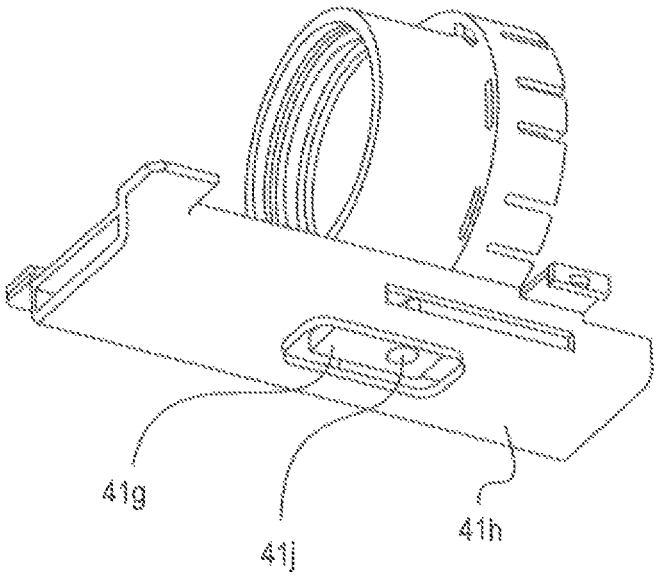

Referring to FIGS. 8, 9, the flange portion 41 will be described. Part (a) of FIG. 8 and part (b) of FIG. 8 are perspective views of the flange portion 41. Part (a) of FIG. 9 is a front view of the flange portion 41, part (b) of FIG. 9 is an E-E sectional view, part (c) of FIG. 9 is a right-hand side view, and part (d) of FIG. 9 is a F-F sectional view.

The flange portion 41 includes a pump connecting portion 41*d* by which the pump portion 54 (FIG. 11) is screwed, a container body connecting portion 41*e* by which the container body 1A is connected, the storage portion 41*f* (part (b) of FIG. 9) for storing the developer fed from the baffle member 40 (FIG. 6). In addition, the flange portion 41 includes a shutter pushing rib 41*k* (part (d) of FIG. 9) for pushing the shutter 52 in the direction of an arrow B (FIG. 14) in the exchange of the developer supply container 1, and the inserting portion 41*c*.

As shown in part (b) of FIG. 8, the flange portion 41 includes an opening seal 41 *g* having a circular seal hole 41*j* for permitting discharge of the developer from the above-described storage portion 41*f*. The opening seal 41 *g* is stuck on the bottom side of the flange portion 41 by a double coated tape and is nipped between the shutter 52 which will be described hereinafter and the flange portion 41 in a compressed state.

The flange portion 41 is provided with a regulation rib 41*i* (part (d) of FIG. 9) for limiting an elastic deformation of a supporting portion 52*d* (part (a) of FIG. 10) of the shutter 52 which will be described hereinafter, with the mounting operation and dismounting operation of the developer supply container 1 relative to the developer receiving apparatus 200. The regulation rib 41*i* projects outwardly beyond an insertion surface of the shutter inserting portion 41*c* (part (d) of FIG. 9) and extends in the mounting direction of the developer supply container 1. The flange portion 41 is provided with a protecting portion 41*h* (part (b) of FIG. 8) for protecting the shutter 52 from damage during transportation and wrong operation by the user.

(Shutter)

Referring to FIG. 10, the shutter 52 will be described. Part (a) of FIG. 10 is a front view of the shutter 52, and part (b) of FIG. 10 is a perspective view.

The shutter 52 is movable relative to the developer supply container 1 (FIG. 6), so that the discharge opening 1*a* provided in the shutter 52 is opened and closed with mounting and demounting operation of the developer supply container 1. The mounting and demounting operation of the developer supply container 1 and the opening and closing of the discharge opening 1*a* will be described in detail hereinafter. The shutter 52 includes a developer sealing portion 52*a* for preventing leakage of the developer through the seal hole 41*j* (part (b) of FIG. 8) of the flange portion 41 when the developer supply container 1 is not mounted to the developer receiving apparatus 200, and a sliding surface 52*i* slidable on the shutter inserting portion 41*c* (part (d) of FIG. 9) of the flange portion 41 on the rear side of the developer sealing portion 52*a*. The shutter 52 further includes stopper portions 52*b*, 52*cs* which are held by shutter stopper portions 200*a*, 200*b* (FIG. 4) of the developer receiving apparatus 200 with the mounting and demounting operation of the developer supply container 1 so that the developer supply container 1 is capable of moving relative to the shutter 52.

The shutter 52 further includes a supporting portion 52*d* for permitting displacement of the stopper portions 52*b*, 52*c*, and the supporting portion 52*d* extends from the developer sealing portion 52*a* and is elastically deformable.

In addition, the developer sealing portion 52*a* is provided with a locking projection 52*e* to prevent movement of the shutter 52 relative to the developer supply container 1 when the developer supply container 1 is not mounted to the developer receiving apparatus 200.

The diameter of the discharge opening 1*a* is preferably as small as possible from the standpoint of minimizing contamination with the developer as a result of leakage of the developer at the time of opening and closing of the shutter 52 when the developer supply container 1 is mounted to the developer receiving apparatus 200, and in this embodiment, it is approx. Φ2 mm. In this embodiment, the seal hole 41*j* and the discharge opening 1*a* are provided on the bottom side of the developer supply container 1, that is, the bottom side of the flange portion 41 (part (b) of FIG. 8), but this is not inevitable, and the connection structure of this embodiment is fundamentally usable if they are provided in the surface other than upstream side (arrow B direction in FIG. 6) with respect to the inserting direction of the developer supply container 1 into the developer receiving apparatus 200 or a downstream side end surface (arrow A direction in FIG. 6).

(Pump Portion)

Referring to FIG. 11, the pump portion 54 will be described. FIG. 11 is a front view of the pump portion 54.

Figure 5:
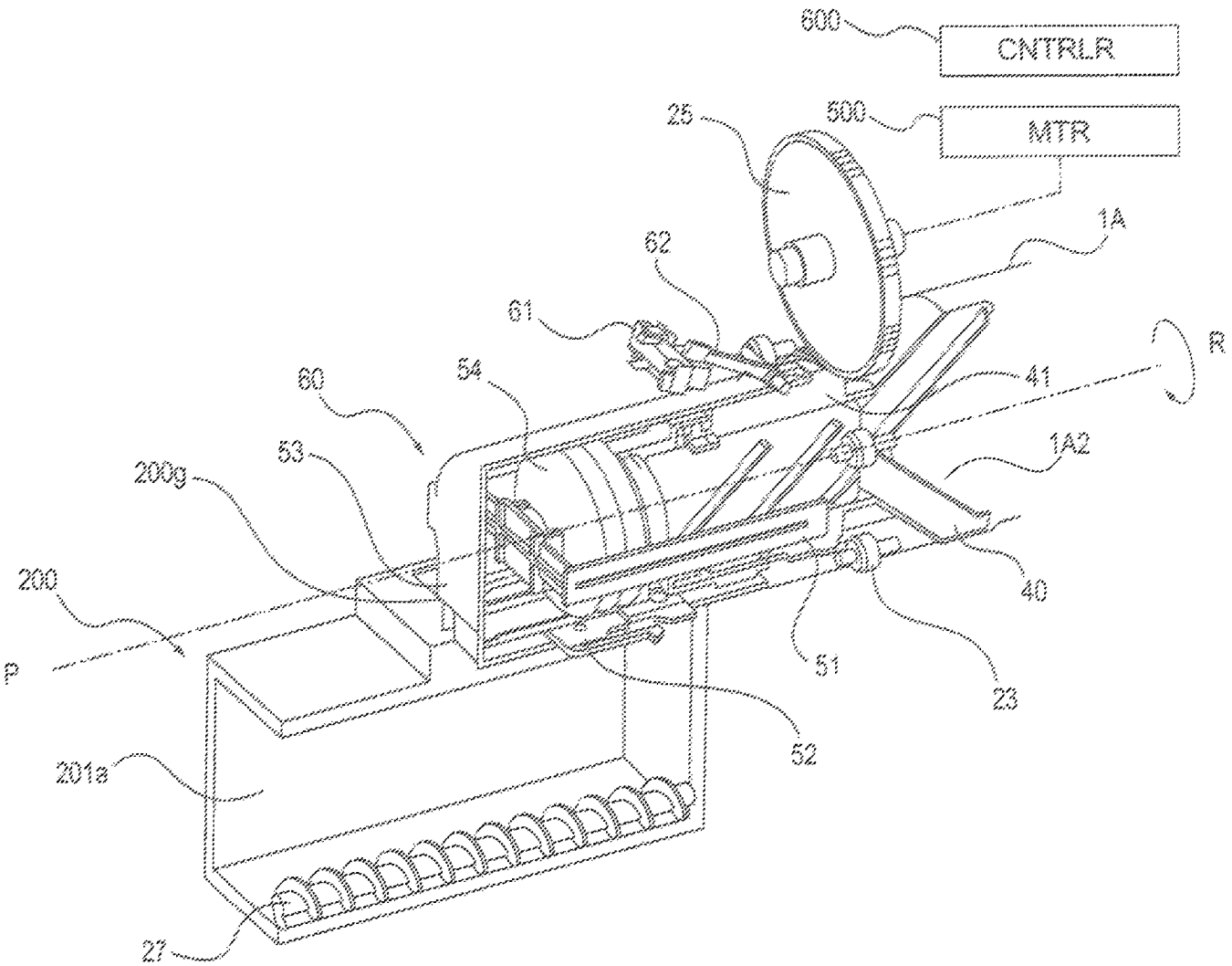
FIG. 5 is a partial perspective view in the state that the developer supply container is in the developer receiving apparatus.

The pump portion 54 functions to periodically change the internal pressure of the developer accommodating portion 1A2 (FIG. 7) by the rotational force received by the drive receiving portion 1A5 (FIG. 7) from the driving gear 25 (FIG. 5).

On the opening end side of the pump portion 54, the connecting portion 54*b* is provided for connection with the flange portion 41 (part (a) of FIG. 8). In this embodiment, the connecting portion 54*b* includes a screw. On the other end portion side of the pump portion 54 is provided with a reciprocating member engaging portion 54*c* engaged with the reciprocating member 51 for the purpose of displacement in synchronism with the reciprocating member 51 which will be described hereinafter.

In this embodiment, the pump portion 54 is provided on the developer supply container 1 (FIG. 6) for the purpose of stably discharging the developer through the small discharge opening 1*a* (part (a) of FIG. 10) as described hereinbefore. The pump portion 54 is a volume change type pump with which the volume changes. By expanding-and-contracting operation of the pump portion 54, the pressure in the developer supply container 1 is changed, so that the developer is discharged.

The pump portion 54 includes a bellow-like expansion-and-contraction portion 54*a* having crests and bottoms periodically provided. The expansion-and-contraction portion 54*a* can expand and fold relative to the crests and bottoms.

In this example, the material of the pump portion 2 is polypropylene resin material (PP), but this is not inevitable. The material of the pump portion 5 may be any if it can provide the expansion and contraction function and can change the internal pressure of the developer accommodating portion by the volume change. The examples includes thin formed ABS (acrylonitrile, butadiene, styrene copolymer resin material), polystyrene, polyester, polyethylene materials. Alternatively, other expandable-and-contractable materials such as rubber are usable. The required function of the pump portion 54 is to change the internal pressure of the developer accommodating portion 1A2 (FIG. 7), and therefore, a piston is usable in place of the pump.

(Reciprocating Member)

Referring to FIG. 12, the reciprocating member 51 will be described. Part (a) of FIG. 12 and part (b) of FIG. 12 are perspective views of the reciprocating member 51.

The reciprocating member 51 is provided with a pump portion engaging portion 51*a* engaged with the reciprocating member engaging portion 54*c* (FIG. 11) provided on the pump portion 54 to change the volume of the pump portion 54. The reciprocating member 51 is provided with engaging projections 51*b* engaged with the above-described cam grooves 1A3 (FIG. 7). The engaging projections 51*b* are disposed adjacent to the free end portion of arms 51*c* extending from a neighborhood of the pump portion engaging portion 51*a*. The reciprocating member 51 is slidable only in the directions indicated by arrows A and B (FIG. 6) by a reciprocating member holding portion 53*b* (part (b) of FIG. 13) of the cover 53 which will be described hereinafter. Therefore, when the container body 1A is rotated by the rotational force received by the drive receiving portion 1A5 (FIG. 7) from the driving gear 25 (FIG. 5), the cam groove 1A3 also rotates in synchronism with the container body 1A, so that the reciprocating member 51 reciprocates in the directions A and B by the function of the cam of the engaging projection 51*b* in the cam groove 1A3 (FIG. 7) and the reciprocating member holding portion 53*b* (part (b) of FIG. 14) of the cover 53 (FIG. 6). In synchronism with the reciprocating motion, the pump portion 54 contracts and expands. On the other words, the reciprocating member 51 covers the rotational force received by the drive receiving portion 1A5 into a force for operating the pump portion 54.

(Cover)

Referring to FIG. 13, the cover 53 will be described. Part (a) of FIG. 13 and part (b) of FIG. 13 is a perspective view of the cover 53.

As described hereinbefore, the cover 53 is provided, as shown in FIG. 6, to prevent the user from touching the developer supply container 1 and therefore from unexpected damage and to protect the reciprocating member 51 and the pump portion 54. More particularly, the cover 53 is integral with the flange portion 41 so as to cover the entirety of the flange portion 41, the pump portion 54 and the reciprocating member 51.

In addition, the cover 53 is provided with a guide groove 53*a* for guiding the insertion of the developer supply container 1 into the developer receiving apparatus 200 by engagement with the insertion guide 200*e* (FIG. 4) of the developer receiving apparatus 200. The cover 53 is provided with the reciprocating member holding portion 53*b* for limiting a rotation displacement of the reciprocating member 51 relative to the axis P (FIG. 6).

The cover 53 is provided with the developer receiving apparatus abutting portion 53*c* for completing the mounting of the developer supply container 1 by abutment to the cover abutting portion 200 *g* (FIG. 5) of the developer receiving apparatus 200 when the developer supply container 1 is inserted into the developer receiving apparatus 200. The mounting and dismounting of the developer supply container 1 relative to the developer receiving apparatus 200 will be described in detail hereinafter.

(Developer Discharging Principle)

Referring to FIG. 6, the developer discharging principle will be described. By the rotation of the developer supply container 1 about the axis P (arrow R direction), a helical projection 1A1 of the container body 1A feeds the developer from an upstream side to the downstream side of the container body 1A (arrow A direction). The developer fed by the helical projection 1A1 reaches the baffle member 40 sooner or later. The developer scooped up by the baffle member 40 integrally rotating with the developer supply container 1 slides down on the baffle member 40 and is fed into the storage portion 41*f* of the flange portion 41 by the inclined projection 40*a*. By repeating such operations, the developer in the developer supply container 1 is sequentially stirred and fed into the storage portion 41*f* of the flange portion 41 (part (b) of FIG. 9).

As described in the foregoing, the pump portion 54 contracts and expands in synchronism with the reciprocating motion of the reciprocating member 51. More particularly, when the pump portion 54 contracts, the inner pressure of the developer supply container 1 increases, and the developer stored in the storage portion 41*f* (part (b) of FIG. 9) is discharged through the discharge opening 1*a* (part (a) of FIG. 10) as if it is pushed out. When the pump portion 54 expands, the inner pressure of the developer supply container 1 is decreased, so that the air is taken in from the outside through the discharge opening 1*a* (part (a) of FIG. 10). By the air taken in, the developer in the neighborhood of the discharge opening 1*a* (part (a) of FIG. 10) and the storage portion 41*f* (part (b) of FIG. 9) is loosened so as to make the next discharging smooth. As described above, by the repeated expansion and contraction motion of the pump portion 54, the developer is discharged.

(Inserting Operation of the Developer Supply Container)

Referring to parts (a)-(d) of FIG. 14, the inserting operation (mounting operation) of the developer supply container in Embodiment 1 will be described.

Part (a) of FIG. 14 illustrates the state halfway of the insertion of the developer supply container 1 into the developer receiving apparatus 200.

Part (b) of FIG. 14 illustrates an advanced state in which the stopper portion 52*b* (part (a) of FIG. 10) provided at the free end portion of the shutter 52 is stopped by the shutter stopper portion 200*a* (FIG. 4) provided in the developer receiving apparatus 200.

Part (c) of FIG. 14 illustrates a completed state in which the developer receiving apparatus abutting portion 53*c* (part (a) of FIG. 13) of the developer supply container 1 is abutted to the cover abutting portion 200 *g* (FIG. 4) so that the mounting of the developer supply container 1 is completed.

Part (d) of FIG. 14 is a G-G sectional view of part (b) of FIG. 14.

When the mounting of the developer supply container 1 into the developer receiving apparatus 200 is started in the direction of the arrow A, the flange unit portion 60 is held so as not to be rotatable about the axis P (FIG. 5) relative to the developer receiving apparatus 200. At this time, the seal hole 41*j* (part (b) of FIG. 8) is still sealed by the developer sealing portion 52*a* (part (b) of FIG. 10) of the shutter 52.

When the developer supply container 1 is inserted further in the direction of arrow A, the shutter 52 becomes unable to further displace in the arrow A direction by the abutment of the stopper portion 52*b* (part (a) of FIG. 10) to the shutter stopper portion 200*a* (FIG. 4), and in this state, only the developer supply container 1 moves in the arrow A direction, and therefore, the shutter 52 slides in the arrow B relative to the developer supply container 1 (part (b) of FIG. 14, part (d) of FIG. 14).

By further sliding the developer supply container 1 in the arrow A to abut the developer receiving apparatus abutting portion 53*c* of the developer supply container 1 to the cover abutting portion 200*g*, the mounting of the developer supply container 1 is completed (part (c) of FIG. 14). At this time, the seal hole 41*j* (part (b) of FIG. 8) provided in the flange portion 41 is aligned with the discharge opening 1*a* (part (a) of FIG. 10) provided in the shutter 52, so that they are in fluid communication with each other, and therefore, the developer supply is enabled.

In this state, when the driving motor (FIG. 5) is driven, the rotational force is transmitted from the driving gear 25 to the drive receiving portion 1A5, so that the container body 1A rotates to feed and discharge the developer.

In part (c) of FIGS. 5, 14, the developer supply container 1 is rotatably supported by the contact between the bottle receiving roller 23 provided on the developer receiving apparatus 200 and the rotation fluctuation regulating portion 1A4, and therefore, is rotatable even by a small driving torque. The bottle receiving roller 23 is rotatably provided on the developer receiving apparatus 200. As described hereinbefore, the developer accommodated in the developer supply container 1 is sequentially discharged through the discharge opening 1*a*, so that the developer is temporarily stored in the developer hopper portion 201*a* (FIG. 14), and is a further supplied into the developing device 201*b* (FIG. 1) by the screw member 27 (FIG. 14), thus accomplishing the developer supply to the developing device 201*b*. The foregoing is the description of the inserting operation of the developer supply container 1.

(Exchanging Operation of Developer Supply Container)

Referring to parts (a)-(d) of FIG. 14, an exchanging operation of the developer supply container 1 will be described. When a substantially total amount of the developer in the developer supply container 1 is consumed with the image formation process operation, developer supply container empty detecting means (unshown) provided in the developer receiving apparatus 200 detects the shortage of the developer in the developer supply container 1, and the event is displayed on the displaying means 100*b* (FIG. 3) of a liquid crystal type or the like to notify the user of the event.

The exchange of the developer supply container 1 is carried out by the user through the following steps.

Figure 3:
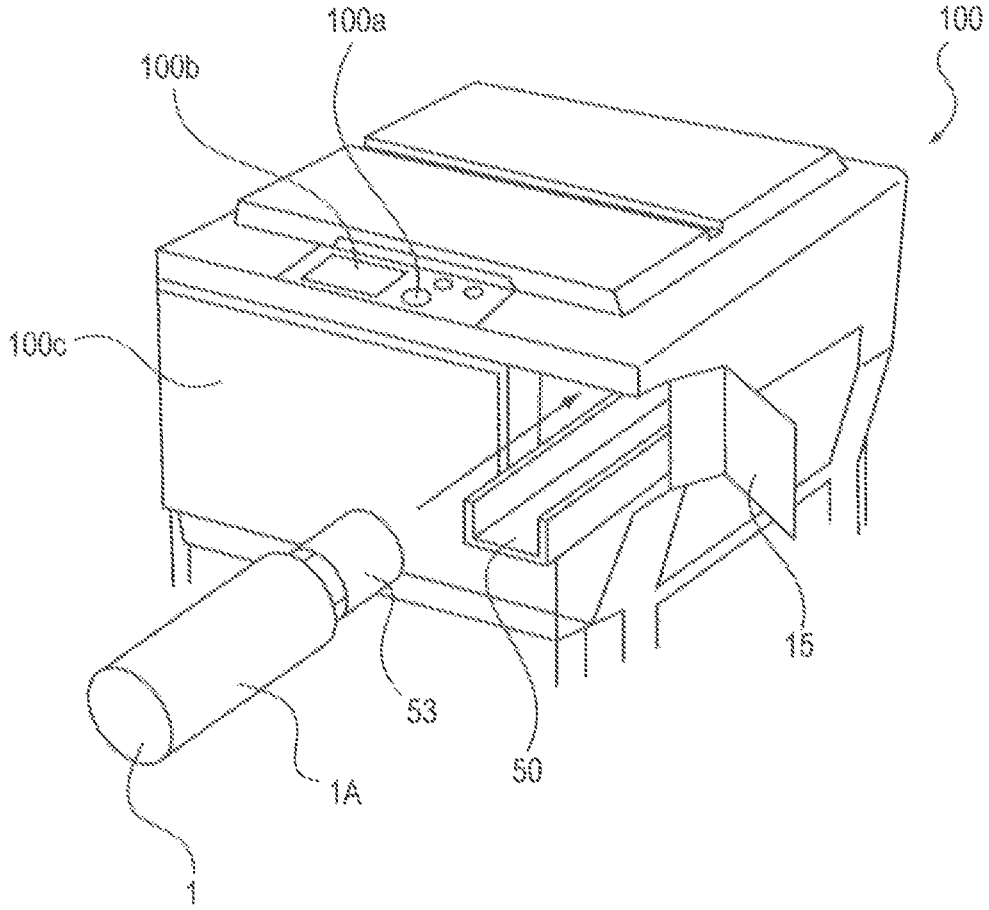
FIG. 3 is a perspective view illustrating mounting of the developer supply container to the main assembly of the image forming apparatus when a developer supply container exchange cover of the main assembly of the image forming apparatus.

First, the exchange front cover 15 which is in the closing the state is opened to the position shown in FIG. 3. Then, the user slides the developer supply container 1 which is in the state shown in part (c) of FIG. 14 in the arrow B direction. At this time, the seal hole 41*j* (part (b) of FIG. 8) of the flange portion 41 and the discharge opening 1*a* (part (a) of FIG. 10) provided in the shutter 52 are aligned with each other and therefore are in fluid communication with each other, that is, they are in the state in which the developer supply is possible.

In this state, the developer supply container 1 is slid in the arrow B direction, and then the shutter pushing rib 41*k* (part (d) of FIG. 9, part (d) of FIG. 14) of the flange portion 41 starts to push the stopper portion 52*b* (part (a) of FIG. 10) of the shutter 52 in the arrow B direction (FIG. 15).

With further sliding of the developer supply container 1 in the arrow B direction, the shutter stopper portion 200*b* (FIG. 4) of the developer receiving apparatus 200 engages with the stopper portion 52*c* (part (a) of FIG. 10) of the shutter 52, so that the shutter stopper portions 52*b*, 52*c* deform about the supporting portion 52*d* (part (a) of FIG. 10) in a direction indicated by a arrow H (part (d) of FIG. 14), and therefore, the shutter 52 advance is in the arrow B direction (part (b) of FIG. 14, part (d) of FIG. 14).

With further sliding of the developer supply container 1 in the arrow B direction, the supporting portion 52*d* (FIG. 10) of the shutter restores by the elastic force thereof, by which the locking between the shutter stopper portion 52*b* and the stopper portion 52*c* by the insertion guide 200*e* is released, so that the seal hole 41*j* (part (b) of FIG. 8) of the flange portion 41 and the developer sealing portion 52*a* (part (b) of FIG. 10) of the shutter 52 are brought into alignment with each other, by which the seal hole 41*j* (part (b) of FIG. 8) is sealed (part (a) of FIG. 14).

Then, the user draws the empty developer supply container 1 out in the arrow B direction shown in part (a) of FIG. 14 and removes it out of the developer receiving apparatus 200. Thereafter, the user inserts a new developer supply container 1 into the developer receiving apparatus 200 in the arrow A direction (part (c) of FIG. 14), and thereafter, closes the exchange front cover 15 (FIG. 3). As described hereinbefore, the seal hole 41*j* (part (b) of FIG. 8) is aligned with the discharge opening 1*a* (part (a) of FIG. 10) of the shutter 52, by which the developer supply is enabled. The foregoing is the description of the developer supply container exchanging operation.

(Developer Supply Control by Developer Receiving Apparatus).

Referring to FIGS. 15, 16, the developer supply control by the developer receiving apparatus 200 according to Embodiment 1 will be described. FIG. 15 is a block diagram illustrating a function and a structure of the control device 600, and FIG. 16 is a flowcharts illustrating the flow of the supplying operation.

In this embodiment, the phase detecting portion 1A6 (FIG. 23) rotating about the axis P contacts the phase detection flag 62, and by the phase detection flag 62 passing the phase sensor 61, the phase (rotational frequency) of the developer supply container 1 is detected. In response to an output of the phase sensor 61, the control device 600 controls (on-off) the driving motor 500, by which the developer in the developer supply container 1 is discharged (supplied) into the developer hopper portion 201*a* quantitatively.

In addition, in this embodiment, an amount (height of developer level) of the developer stored temporarily stored in the developer hopper portion 201*a* is limited. So, there is provided a developer sensor 24*k* (unshown) for detecting the developer amount contained in the developer hopper portion 201*a*. In accordance with the output of the developer sensor 24*k*, the control device 600 on-off-controls the driving motor 500 so that the developer is accommodated beyond a predetermined amount in the developer hopper portion 201*a*.

A control flow will be described. First, as shown in FIG. 16, the developer sensor 24*k* checks the developer remainder in the developer hopper portion 201*a* (S100). If the developer accommodation capacity detected by the developer sensor 24*k* is less than a predetermined level, that is, the developer sensor 24*k* does not detect the developer, the driving motor 500 is actuated to carry out the developer supply (S101).

Then, it is checked whether or not the phase detection flag 62 passes the phase sensor 61 (S102). When the phase detection flag 62 does not pass the phase sensor 61, the supply of the developer continues (S103). On the other hand, when the phase detection flag 62 passes the phase sensor 61, the driving motor 500 is deactivated (S105), and the developer remainder in the developer hopper portion 201*a* is checked again (S100). By the on-off control of the developer supplying operation on the basis of the detection of the phase (rotation) of the developer supply container 1 in this manner, the quantitative developer supply can be carried out. In addition, by detecting the phase (rotation) of the developer supply container 1, the developer remainder in the developer supply container 1 can be predicted to a certain extent.

When it is discriminated by the developer sensor 24*k* that the detected developer accommodation capacity reaches a predetermined amount, that is, the developer is detected by the developer sensor 24*k*, the driving motor 500 is deactivated to stop the developer supplying operation. By the stop of the supplying operation, the series of developer supplying steps is completed.

The above-described the developer supplying steps are carried out each time the developer accommodation capacity in the developer hopper portion 201*a* becomes less than the predetermined level as a result of consumption of the developer with the image forming operation.

(Comparison in Supply Accuracy, Image Quality, Rotation Drive Load)

Referring to FIGS. 17-24, comparison example 1, modified examples 1-5, Embodiment 1 will be compared in the supply accuracy, the image quality and the rotation drive load. The supply accuracy, the image quality and the rotation drive load are compared depending on the differences in the arrangement of the drive receiving portion 1A5, the rotation fluctuation regulating portion 1A4 and the phase detecting portion 1A6, which most reflect the effects of the present invention. In this embodiment, a cam groove 1A3 (FIG. 24) is added as compared with the Embodiment 2 which will be described hereinafter, and the cam groove 1A3 is preferably disclosed in the downstreammost disposition with respect to the container inserting direction. This is because the reciprocating member 51 can be downsized by this arrangement. FIG. 17 is a partial enlarged view of a comparison example 1, FIG. 18 a partial enlarged view of modified example 1, FIG. 19 is a partial enlarged view of modified example 2, FIG. 20 is a partial enlarged view of modified example 3, FIG. 21 is a partial enlarged view of modified example 4, FIG. 22 is a partial enlarged view of modified example 5, FIG. 23 is a partial enlarged view of Embodiment 1, and FIG. 24 is a partial enlarged view in the state that the cover 53 is removed in Embodiment 1.

Table 1 shows the supply accuracy, the image quality, the rotation drive load of the developer supply container 1 during the developer supply in each of the structures.

TABLE 1

| | Positions with respect to the developer container inserting direction | | | | Supply | Image | Rotational driving |
|---|---|---|---|---|---|---|---|
| Arrangement | Downstream | | | Upstream | accuracy | quality | load |
| Comp. Ex. 1 | Cam groove | — | Phase detecting portion | Drive receiving portion | 40% | Δ | ◎ |
| Modified Ex. 1 | Cam groove | Drive receiving portion | Phase detecting portion | Fluctuation regulating portion | 20% | ○ | Δ |
| Modified Ex. 2 | Cam groove | Phase detecting portion | Drive receiving portion | Fluctuation regulating portion | 30% | ◎ | ○ |
| Modified Ex. 3 | Cam groove | Fluctuation regulating portion | Drive receiving portion | Phase detecting portion | 30% | ◎ | ○ |
| Modified Ex. 4 | Cam groove | Fluctuation regulating portion | Phase detecting portion | Drive receiving portion | 20% | ○ | ◎ |
| Modified Ex. 5 | Cam groove | Drive receiving portion | Fluctuation regulating portion | Phase detecting portion | 20% | ◎ | Δ |
| Embodiment 1 | Cam groove | Phase detecting portion | Fluctuation regulating portion | Drive receiving portion | 20% | ◎ | ◎ |

In the Table, the values and the signs mean as follows.

The supply accuracy 20% means that supply accuracy is within ±20% relative to the target value. By the arrangement of the phase detecting portion and the rotation fluctuation regulating portion adjacent to each other, the vibration attributable to the rotation fluctuation of the phase detecting portion is limited, so that the detection accuracy by the phase detection flag 62 and the phase sensor 61 is improved. As a result, the phase determination between the baffle member 40 and the cam groove 1A3 during the toner discharging is accurate, so that the developer amount stored in the storage portion 41*f* and the expansion and contraction amounts of the pump portion 54 are stabilized, and therefore, the supply accuracy is improved.

The supply accuracy 30% means that supply accuracy is within ±30% relative to the target value. Similarly to the case of supply accuracy equal to 20%, the vibration attributable to the rotation fluctuation of the phase detecting portion can be limited by the rotation fluctuation regulating portion, and therefore, the supply accuracy is improved. However, because the phase detecting portion and the rotation fluctuation regulating portion are not disposed adjacent to each other, the vibration regulating effect is lower, and therefore, the supply accuracy is lower than that in the case of the supply accuracy equals to 20%.

The supply accuracy 40% means that supply accuracy is within ±40% relative to the target value. Because the rotation fluctuation regulating portion is not provided, the supply accuracy is low as compared with the case of supply accuracy of 30%, due to the vibration attributable to the rotation fluctuation of the phase detecting portion.

The image quality ◎ means that the rotational drive transmission and therefore the image quality are improved because the drive receiving portion and the rotation fluctuation regulating portion are disposed adjacent to each other, and therefore, the vibration attributable to the rotation fluctuation of the drive receiving portion can be limited, and the rotational drive transmission is improved.

The image quality ○ means similarly to the case of ◎ that the rotational drive transmission and therefore the image quality are improved because the drive receiving portion and the rotation fluctuation regulating portion are disposed adjacent to each other, and therefore, the vibration attributable to the rotation fluctuation of the drive receiving portion can be limited, and the drive transmission is improved. However, the vibration regulating effect is lower, and the image quality is lower than those in the case of ◎, because the drive receiving portion and the rotation fluctuation regulating portion are not disposed adjacent to each other.

The image quality Δ means that the image quality is lower than that in the case of ○ due to vibration attributable to the rotation fluctuation of the drive receiving portion, because no rotation fluctuation regulating portion is provided, When the developer supply container 1 is inserted into the developer receiving apparatus 200, the phase detecting portion 1A6, the rotation fluctuation regulating portion 1A4 and the drive receiving portion 1A5 of the container body 1A abut to or engage with the phase detection flag 62, the bottle receiving roller 23 and the driving gear 25 provided in the developer receiving apparatus 200 (FIG. 23). Therefore, the outer configurations, in the circumferential direction of the phase detecting portion, of the rotation fluctuation regulating portion and the drive receiving portion preferably gradually increase from the downstream side with respect to the container inserting direction from the standpoint of user's operationality when the developer supply container 1 is inserted into the developer receiving apparatus 200. From this, the outer configuration of the drive receiving portion in the circumferential direction is limited by the positions and structures of the phase detecting portion, the rotation fluctuation regulating portion and the drive receiving portion, with the result of influence to the drive load when the developer supply container 1 rotates. The influence of the difference in the arrangement and structures of the phase detecting portion, the rotation fluctuation regulating portion, the drive receiving portion on the drive load, and the meaning of the symbols will be described.

Rotation drive load ◎ means that the rotation drive load is the minimum, because the drive receiving portion is disposed in the upstreammost side with respect to the container inserting direction among the phase detecting portion, the rotation fluctuation regulating portion and the drive receiving portion, and therefore, the outer diameter of the drive receiving portion can be the maximum.

Rotation drive load ○ means that the rotation drive load of the drive receiving portion is small because the drive receiving portion is disposed in the second place from the upstreammost side with respect to the container inserting direction among the phase detecting portion, the rotation fluctuation regulating portion and the drive receiving portion, and therefore, the outer diameter of the drive receiving portion can be second largest, but the rotation drive load of the drive receiving portion is larger than in the case of ◎.

Rotation drive load Δ means that the rotation drive load is large because the drive receiving portion is disposed in the third place from the upstreammost side with respect to the container inserting direction among the phase detecting portion, the rotation fluctuation regulating portion and the drive receiving portion, and therefore, the outer diameter of the drive receiving portion is the smallest, and the rotation drive load of the drive receiving portion is larger than in the case of ○.

Comparison Example 1

Referring to FIG. 17, comparison example 1 will be described. The container of comparison example 1 is different from that of Embodiment 1 in the arrangements of the drive receiving portion 1A5 of the container body 1A, the phase detecting portion 1A6 (no rotation fluctuation regulating portion 1A4), the driving gear 25, the phase detection flag 62, the phase sensor 61 and the bottle receiving roller 23, and is similar to that of Embodiment 1 on the other respects. More specifically, they are arranged in the order of the phase detecting portion 1A6 and the drive receiving portion 1A5 from the downstream side (arrow A direction) with respect to the inserting direction of the developer supply container 1.

With this arrangement, no rotation fluctuation regulating portion is provided, and therefore, the supply accuracy is poor due to the vibration attributable to the rotation fluctuation of the phase detecting portion, and the supply accuracy is target value ±40%.

As regards the image quality, the image quality is poor due to the vibration attributable to the rotation fluctuation of the drive receiving portion, as compared with the case having the rotation fluctuation regulating portion.

As regards the rotation drive load, when the drive receiving portion is disposed at the upstreammost position with respect to the inserting direction of the container, the outer diameter of the drive receiving portion can be made the maximum, and therefore, the rotation drive load can be made minimum.

Modified Example 1

Referring to FIG. 18, modified example 1 of Embodiment 1 will be described. In modified example 1, the arrangement of the drive receiving portion 1A5, the rotation fluctuation regulating portion 1A4 and the phase detecting portion 1A6 of the container body 1A, and the driving gear 25, the phase detection flag 62, the phase sensor 61 and the bottle receiving roller 23 is different from that of Embodiment 1, and the other structures are the same as those of Embodiment 1. More particularly, the cam groove 1A3, the drive receiving portion 1A5, the phase detecting portion 1A6 and the rotation fluctuation regulating portion 1A4 are positioned in the order named from the downstream side with respect to the inserting direction of the developer supply container 1 (arrow A direction).

With this arrangement, the phase detecting portion and the rotation fluctuation regulating portion are disposed adjacent to each other, so that, the vibration of the phase detecting portion attributable to the rotation fluctuation can be effectively limited, and therefore, the supply accuracy is better as compared with the case of comparison example 1 not employing the rotation fluctuation regulating portion 1A4, and the supply accuracy is the target value ±20%.

As regards the image quality, by limiting the vibration attributable to the rotation fluctuation of the drive receiving portion by the rotation fluctuation regulating portion, the drive transmission is improved, and therefore, the improvement in the image quality can be expected over the case of comparison example 1 not employing the rotation fluctuation regulating portion 1A4. However, because the drive receiving portion and the rotation fluctuation regulating portion are not disposed adjacent to each other, the vibration regulating effect and the image quality are poor as compared with the case in which the drive receiving portion and the rotation fluctuation regulating portion are disposed adjacent to each other.

As regards the rotation drive load, the drive receiving portion is disposed in the third place from the upstream side with respect to the container inserting direction among the phase detecting portion (portion-to-be-detected), the rotation fluctuation regulating portion (contact portion) and the drive receiving portion, and therefore, the outer diameter of the drive receiving portion is the minimum, with the result that the rotation drive load is the largest as compared with the case in which the drive receiving portion is disposed in the first or second place from the upstream side with respect to the container inserting direction.

Modified Example 2

Referring to FIG. 19, modified example 2 of Embodiment 1 will be described. In modified example 4, the arrangement of the drive receiving portion 1A5, the rotation fluctuation regulating portion 1A4 and the phase detecting portion 1A6 of the container body 1A, and the driving gear 25, the phase detection flag 62, the phase sensor 61 and the bottle receiving roller 23 is different from that of Embodiment 1. More specifically, the cam groove 1A3, the phase detecting portion 1A6, the drive receiving portion 1A5 and the rotation fluctuation regulating portion 1A4 are arranged in the order named from the downstream side with respect to the inserting direction (arrow A direction) of the developer supply container 1.

With this arrangement, the vibration attributable to the rotation fluctuation of the phase detecting portion can be limited by the rotation fluctuation regulating portion, and therefore, the improvement in the supply accuracy can be expected over the comparison example 1 not employing the rotation fluctuation regulating portion 1A4. However, the phase detecting portion and the rotation fluctuation regulating portion are not disposed adjacent to each other, and therefore, the vibration regulating effect is poor as compared with the case in which the phase detecting portion and the rotation fluctuation regulating portion are disposed adjacent to each other, and the supply accuracy is approximately targeted value ±30%.

As regards the image quality, the drive receiving portion and the rotation fluctuation regulating portion are disposed adjacent to each other so that the vibration attributable to the rotation fluctuation of the drive receiving portion is efficiently limited, and therefore, the drive transmission is improved, and the improvement in the image quality can be expected over the case of comparison example 1 not employing the rotation fluctuation regulating portion 1A4.

As regards the rotation drive load, the drive receiving portion is disposed in the second place from the upstream side with respect to the container inserting direction among the phase detecting portion (portion-to-be-detected), the rotation fluctuation regulating portion (contact portion) and the drive receiving portion, and therefore, the outer diameter of the drive receiving portion is the second largest, and for this reason, the rotation drive load of the drive receiving portion can be reduced. However, the rotation drive load is larger than in the case in which the drive receiving portion is disposed in the upstreammost position from the upstream side with respect to the container inserting direction.

Modified Example 3

Referring to FIG. 20, modified example 3 of Embodiment 1 will be described. In modified example 4, the arrangement of the drive receiving portion 1A5 of the flange portion 41, the rotation fluctuation regulating portion 1A4, the phase detecting portion 1A6, the driving gear 25, the phase detection flag 62, the phase sensor 61 and the bottle receiving roller 23 is different from that of Embodiment 1, and the other structures are similar to those of Embodiment 1. More specifically, the cam groove 1A3, the rotation fluctuation regulating portion 1A4, the drive receiving portion 1A5 and the phase detecting portion 1A6 are arranged in the order named from the downstream side with respect to the inserting direction (arrow A direction) of the developer supply container 1.

With this arrangement, the vibration attributable to the rotation fluctuation of the phase detecting portion can be limited by the rotation fluctuation regulating portion, and therefore, the improvement in the supply accuracy can be expected over the comparison example 1 not employing the rotation fluctuation regulating portion 1A4. The however, the phase detecting portion and the rotation fluctuation regulating portion are not disposed adjacent to each other, and therefore, the vibration regulating effect is poor as compared with the case in which the phase detecting portion and the rotation fluctuation regulating portion are disposed adjacent to each other, and the supply accuracy is approximately targeted value ±30%.

As regards the image quality, the drive receiving portion and the rotation fluctuation regulating portion are disposed adjacent to each other so that the vibration attributable to the rotation fluctuation of the drive receiving portion is efficiently limited, and therefore, the drive transmission is improved, and the improvement In the image quality can be expected over the case of comparison example 1 not employing the rotation fluctuation regulating portion 1A4.

As regards the rotation drive load, the drive receiving portion is disposed in the second place from the upstream side with respect to the container inserting direction among the phase detecting portion (portion-to-be-detected), the rotation fluctuation regulating portion (contact portion) and the drive receiving portion, and therefore, the outer diameter of the drive receiving portion is the second largest, and for this reason, the rotation drive load of the drive receiving portion can be reduced. However, the rotation drive load is larger than in the case in which the drive receiving portion is disposed in the upstreammost position from the upstream side with respect to the container inserting direction.

Modified Example 4

Referring to FIG. 21, modified example 4 of Embodiment 1 will be described. In modified example 4, the arrangement of the drive receiving portion 1A5, the rotation fluctuation regulating portion 1A4 and the phase detecting portion 1A6 of the container body 1A, and the driving gear 25, the phase detection flag 62, the phase sensor 61 and the bottle receiving roller 23 is different from that of Embodiment 1, and the other structures are the same as in Embodiment 1. More particularly, the cam groove 1A3, the rotation fluctuation regulating portion 1A4, the phase detecting portion 1A6 and the drive receiving portion 1A5 are positioned in the order named from the downstream side with respect to the inserting direction of the developer supply container 1 (arrow A direction).

With this arrangement, the phase detecting portion and the rotation fluctuation regulating portion are disposed adjacent to each other, and therefore, the vibration of the phase detecting portion attributable to the rotation fluctuation can be effectively limited, and therefore, the supply accuracy is better as compared with the case of comparison example 1 without the rotation fluctuation regulating portion 1A4, and the supply accuracy is the target value ±20%.

As regards the image quality, the vibration attributable to the rotation fluctuation of the drive receiving portion can be limited by the rotation fluctuation regulating portion, and therefore, the improvement in the image quality can be expected over the case of comparison example 1 not employing the rotation fluctuation regulating portion 1A4. However, because the drive receiving portion and the rotation fluctuation regulating portion are not disposed adjacent to each other, the vibration regulating effect and the image quality are poor as compared with the case in which the drive receiving portion and the rotation fluctuation regulating portion are disposed adjacent to each other.

As regards the rotation drive load, when the drive receiving portion is disposed at the upstreammost position with respect to the inserting direction of the container, the outer diameter of the drive receiving portion can be made the maximum, and therefore, the rotation drive load can be made minimum.

Modified Example 5

Referring to FIG. 22, modified example 5 of Embodiment 1 will be described. In modified example 5, the arrangement of the drive receiving portion 1A5 of the container body 1A, the rotation fluctuation regulating portion 1A4, the phase detecting portion 1A6, the driving gear 25, the phase detection flag 62, the phase sensor 61 and bottle receiving roller 23 is different from that of Embodiment 1, and the other structures are the same as those of Embodiment 1. More specifically, the cam groove 1A3, the drive receiving portion 1A5, the rotation fluctuation regulating portion 1A4 and the phase detecting portion 1A6 are arranged in the order named from the downstream side with respect to the inserting direction (arrow A direction) of the developer supply container 1.

With this arrangement, the phase detecting portion and the rotation fluctuation regulating portion are disposed adjacent to each other, and the vibration of the phase detecting portion attributable to the rotation fluctuation can be efficiently limited, and therefore, the improvement in the supply accuracy can be expected over the case of comparison example 1 not employing the rotation fluctuation regulating portion 1A4, and the supply accuracy is approximately target value ±20%.

As regards the image quality, the drive receiving portion and the rotation fluctuation regulating portion are disposed adjacent to each other so that the vibration attributable to the rotation fluctuation of the drive receiving portion is efficiently limited, and therefore, the drive transmission is improved, and the improvement In the image quality can be expected over the case of comparison example 1 not employing the rotation fluctuation regulating portion 1A4.

As regards the rotation drive load, the drive receiving portion is disposed in the third place from the upstream side with respect to the container inserting direction among the phase detecting portion (portion-to-be-detected), the rotation fluctuation regulating portion (contact portion) and the drive receiving portion, and therefore, the outer diameter of the drive receiving portion is the minimum, with the result that the rotation drive load is the largest as compared with the drive receiving portion is disposed in the first or second place from the upstream side with respect to the container inserting direction.

Embodiment 1

Referring to FIGS. 23, 24, Embodiment 1 will be further described. As regards the drive receiving portion 1A5, the rotation fluctuation regulating portion 1A4 and the phase detecting portion 1A6 of the container body 1A, the arrangement is such that the cam groove 1A3, the phase detecting portion 1A6, the rotation fluctuation regulating portion 1A4 and the drive receiving portion 1A5 are arranged in the order named from the downstream side with respect to the inserting direction of the developer supply container 1 (arrow A direction).

With this arrangement, the phase detecting portion and the rotation fluctuation regulating portion are disposed adjacent to each other, and the vibration Of the phase detecting portion attributable to the rotation fluctuation can be efficiently limited, and therefore, the improvement in the supply accuracy can be expected over the case of comparison example 1 not employing the rotation fluctuation regulating portion 1A4, and the supply accuracy is approximately target value ±20%.

As regards the image quality, the drive receiving portion and the rotation fluctuation regulating portion are disposed adjacent to each other, and therefore, the vibration of the drive receiving portion due to the rotation fluctuation is efficiently limit, so that the drive transmission is improved, and the improvement in the image quality can be expected over the case of comparison example 1 not employing the rotation fluctuation regulating portion 1A4.

As regards the rotation drive load, because the drive receiving portion is disposed at the upstreammost position with respect to the inserting direction of the container, the outer diameter of the drive receiving portion can be made the maximum, and therefore, the rotation drive load can be made minimum.

In the above-described comparison, the comparison example 1, the modified example 1-5 and the Embodiment 1 are compared in the supply accuracy, the image quality and the rotation drive load, but in the present invention, the drive receiving portion 1A5, the rotation fluctuation regulating portion 1A4 and the phase detecting portion 1A6 may be arranged in any way.

Nevertheless, when the comparison is made in the supply accuracy, the image quality and the rotation drive load, the evaluations are dependent on the arrangement of the drive receiving portion 1A5, the rotation fluctuation regulating portion 1A4 and the phase detecting portion 1A6. The preferable arrangement and structures of the drive receiving portion 1A5, the rotation fluctuation regulating portion 1A4 and the phase detecting portion 1A6 will be described.

As regards the rotation drive load, by the dispositions of the drive receiving portion 1A5 in the upstreammost side with respect to the inserting direction of the container, the outer diameter of the drive receiving portion can be made the largest, by which the rotation drive load can be minimized.

As regards the supply accuracy, by the disposition of the phase detecting portion and the rotation fluctuation regulating portion adjacent to each other, the vibration attributable to the rotation fluctuation of the phase detecting portion can be effectively limited, and therefore, the detection accuracy between the phase detection flag 62 and the phase sensor 61 is improved. As a result, the phase determination of the baffle member 40 can be made precise during the toner discharging, and therefore, the supply accuracy can be improved over comparison example 1 not employing the rotation fluctuation regulating portion 1A4.

As regards the image quality, by the disposition of the drive receiving portion and the rotation fluctuation regulating portion adjacent to each other, the vibration of the drive receiving portion attributable to the rotation fluctuation can be effectively limited, and therefore, the drive transmission is improved, and the improvement in the image quality can be expected over the case of comparison example 1 not employing the rotation fluctuation regulating portion 1A4.

From the foregoing, the optimum structure is that the cam groove 1A3, the phase detecting portion 1A6, the rotation fluctuation regulating portion 1A4 and the drive receiving portion 1A5 are arranged in the order named from the downstream side with respect to the container inserting direction that is, the structure of Embodiment 1 is most preferable.

According to this embodiment, by limiting the rotation fluctuation of the developer supply container during the developer supply by the rotation fluctuation regulating portion, the rotation fluctuations of both of the phase detecting portion and the drive receiving portion can be reduced. As a result, the accuracies of both of the drive transmission and the phase detection can be improved. Furthermore, the vibration resulting from the rotation of the developer supply container can be reduced, by which the image quality can be improved.

Particularly, in this embodiment, the amounts of rotation and/or rotation stop positions of the container body 1A and the baffle member 40 provided in the container body 1A are controlled on the basis of the phase detection result of the phase detecting portion 1A6, and therefore, the developer feeding amount and timing in the container can be easily and accurately controlled because of the close positioning of the rotation fluctuation regulating portion 1A4.

Furthermore, in this embodiment, by the rotation of the container body 1A4, the pump portion 54 for discharging the discharging is driven. Therefore, the accuracy of the detection of the phase detecting portion 1A6 leads to the accuracy in the control of the developer discharge amount from the developer supply container 1.

From the foregoing, the above-described arrangement of the phase detecting portion 1A6, the rotation fluctuation regulating portion 1A4 and the drive receiving portion 1A5 is particularly effective in the case of the developer supply container including the baffle member 40 and/or the pump portion 54 employed in this embodiment.

Embodiment 2

Embodiment 2 will be described. In Embodiment 2, a part of the structure of the developer supply container 1 is different, and the structure of the developer receiving apparatus 200 and the mounting and demounting operation of the developer supply container 1 relative to the developer receiving apparatus 200 a different correspondingly. The other structures are substantially equivalent to those of Embodiment 1. Therefore, in the description of this embodiment, the same reference numerals as in Embodiment 1 are assigned to the elements having the corresponding functions in this embodiment, and the detailed description thereof is omitted for simplicity.

In the following description, the description about the fundamental structures of the image forming apparatus is omitted, and the description will be made as to the developer supplying system, that is, the structures of the developer receiving apparatus (developer supplying apparatus) and the developer supply container.

(Developer Receiving Apparatus)

Referring first to FIG. 26, the developer receiving apparatus 200 will be described. FIG. 26 is a sectional perspective view illustrating the state halfway of insertion of the developer supply container 1 (FIG. 25) into the developer receiving apparatus 200 in the direction of an arrow A, in Embodiment 2.

As shown in FIG. 26, the developer receiving apparatus 200 mainly includes a bottle receiving roller 23 to be contacted by a rotation fluctuation regulating portion (contact portion) 1A4 of the developer supply container 1 which will be described hereinafter, and a driving gear 25 for transmitting a rotational force to a drive receiving portion 1A5 of the developer supply container 1. The developer receiving apparatus 200 further includes a phase detection flag 62 for detecting a phase (rotation) of the developer supply container 1 by being contacted by a phase detecting portion (portion-to-be-detected) 1A6 of the developer supply container 1, and a phase sensor 61 for detecting phase detection flag 62. The developer receiving apparatus 200 further includes a developer hopper portion 201*a* for temporarily storing the developer discharged from the developer supply container 1, and a screw member 27 for feeding the developer in the developer hopper portion 201*a* into a developing device 201 (FIG. 1). Furthermore, the developer receiving apparatus 200 includes a sealing member engaging portion 20 engaged with a sealing member 2 of the developer supply container 1 which will be described hereinafter, and a partition 200*f* in fluid communication with the developer hopper portion 201*a*. The partition 200*f* is provided with a sealing member (unshown) for rotatably supporting a part of the developer supply container 1 and for sealing the developer hopper portion 201*a*. The phase detection flag 62 is urged downwardly by an elastic member (unshown) and is rotatable about a rotational axis Q (FIG. 17).

(Developer Supply Container)

Referring to FIGS. 25, 26 and 27, the developer supply container 1 of Embodiment 2 will be described. FIG. 25 is a partial perspective view of the developer supply container 1 in Embodiment 1. FIG. 26 is a partial perspective view illustrating the state halfway of insertion of the developer supply container into the developer receiving apparatus 200 in the direction indicated by A. Parts (a)-(c) of FIG. 27 is a partially sectional view illustrating steps of insertion of the developer supply container 1 into the developer receiving apparatus 200 in the direction of the arrow A up to the insertion completion.

As shown in FIG. 25, the developer supply container 1 mainly includes a container body 1A, a flange portion 41, a baffle member 40 and the sealing member 2.

The developer supply container 1 is substantially cylindrical, and a discharge opening 1*a* having a diameter smaller than that of the cylindrical portion of the container body 1A is provided substantially at the center portion of one end thereof. The discharge opening 1*a* is provided with a sealing member 2 for closing the discharge opening 1*a*, and the discharge opening 1*a* is opened and closed by sliding the sealing member 2 relative to the developer supply container 1 (directions indicated by the arrow A or B), as will be understood by the description which will be made hereinafter in conjunction with parts (a)-(c) of FIG. 27.

Referring to FIG. 25, the inside structure of the developer supply container 1 will be described. As described, the developer supply container 1 has a substantially cylindrical shape and extend substantially horizontally in the developer receiving apparatus 200, and the developer supply container 1 receives the rotational force to rotate about an axis P in the direction of an arrow R.

In the developer supply container 1, the baffle member 40 is provided to feed the developer. By the rotation of the developer supply container 1, the developer is fed from the upstream side to the downstream side (arrow A direction) of the developer supply container 1 by a helical projection 1A1 to reach the baffle member 40 sooner or later. One end portion of an inclined projection 40*a* is connected with the discharge opening 1*a*, and the developer is finally fed to the discharge opening 1*a* by sliding down on the projection 40*a* with the rotation of the baffle member 40.

The inside structure or shape of the developer supply container 1 is not particularly limited, as long as the developer can be discharged by the rotational force received from the developer receiving apparatus 200. That is, as regards the internal structure of the developer supply container 1, a well-known helical projection 1A1 of embodiment 1 or the like is usable.

(Container Body)

Referring to FIG. 25, the container body 1A will be described. As shown in FIG. 25, the container body 1A includes a developer accommodating portion 1A2 for accommodating the developer, and a helical projection 1A1 for feeding the developer in the direction indicated by an arrow A in the developer accommodating portion 1A2 by the rotation of the container body 1A about the axis P in the direction indicated by R.

(Flange Portion)

Referring to FIGS. 25, 26, the flange portion 41 will be described. As shown in FIG. 25, the flange portion 41 is mounted to the container body 1A, and the flange portion 41 and the container body 1A rotated integrally about the rotational axis P in the direction indicated by the arrow R. The flange portion 41 has a substantially hollow-cylindrical shape, and a cylindrical portion is projected from a substantially center portion of one end surface thereof, and a free end side of the cylindrical portion functions as the discharge opening 1*a* for discharging the developer into the developer hopper portion 201*a* (FIG. 26).

As shown in FIG. 26, the flange portion 41 is provided integrally with a drive receiving portion (drive inputting portion) 1A5 formed on the entire outer periphery at the other end surface portion to receive the rotational force from the developer receiving apparatus 200, the rotation fluctuation regulating portion 1A4 for limiting the rotation fluctuation of the developer supply container 1 by contacting the bottle receiving roller 23, and a phase detecting portion 1A6 for detecting a rotational phase at a part of the peripheral surface.

In this embodiment, the drive receiving portion 1A5, the rotation fluctuation regulating portion 1A4 and the phase detecting portion 1A6 are integrally formed with the flange portion 41, but the structure is not limiting to the present invention. For example, the drive receiving portion 1A5, the rotation fluctuation regulating portion 1A4 and the phase detecting portion 1A6 may be formed as separate members and then may be mounted integrally.

The developer accommodating portion 1A2 is constituted by the container body 1A and an inside space of the flange portion 41 as well.

In this embodiment, the phase detecting portion 1A6 is recessed from the rotation fluctuation regulating portion 1A4, but it may be projected from the rotation fluctuation regulating portion 1A4.

In this embodiment, a circularity of the rotation fluctuation regulating portion 1A4 is 0.05 to improve play preventing effect, in the radial direction, of the drive receiving portion 1A5 and the phase detecting portion 1A6 when the developer is supplied by the rotation of the developer supply container 1 in the R direction (FIG. 30). The circularity of the rotation fluctuation regulating portion 1A4 is preferably high since then the radial play preventing effect is high, but high circularity leads to the high cost, and 0.05 of the circularity it is selected as a not unnecessarily high geometrical tolerance.

With such a structure, the fluctuations of rotations of the phase detecting portion 1A6 and the drive receiving portion 1A5 can be suppressed by the contact between the rotation fluctuation regulating portion 1A4 which is close to a true circle and the bottle receiving rollers when the developer supply container 1 rotates in the arrow R direction of FIG. 30. As a result, the accuracies of both of the drive transmission and the phase detection are expected. Furthermore, the vibration resulting from the rotation of the developer supply container 1 can be reduced, and therefore, the improvement in the image quality is expected.

In addition, the drive receiving portion 1A5 and the phase detecting portion 1A6 are disposed adjacent to the rotation fluctuation regulating portion 1A4. With such a structure, the rotation fluctuations of both of the phase detecting portion 1A6 and the drive receiving portion 1A5 can be suppressed as compared with the structure in which the drive receiving portion 1A5 and the phase detecting portion 1A are disposed away from each other. As a result, the accuracies of the drive transmission and the phase detection are improved, and the image quality is also improved.

(Baffle Member)

Referring to FIG. 25, a baffle member 40 will be described. As shown in FIG. 25, the baffle member 40 is mounted to the container body 1A, and therefore, the baffle member 40 and the container body 1A are rotated integrally with each other about the axis P in the arrow R direction. The baffle member 40 is provided with a plurality of inclined projections 40*a* on each of the front and back surfaces thereof, and one end portion of the inclined projections 40*a* reaches the discharge opening 1*a*.

(Sealing Member)

Referring to FIGS. 28-30, the structure of the sealing member 2 in Embodiment 2 will be described. Part (a) of FIG. 28 and part (b) of FIG. 28 are perspective views of the sealing member 2. Part (a) of FIG. 29 a front view, part (b) is a left-hand side view, part (c) is a right-hand side view, part (d) is a top plan view, and part (e) is a C-C sectional view. FIG. 30 is a sectional perspective view illustrating a state in which the developer supply container 1 is in engagement with the sealing member engaging portion 20 of the developer receiving apparatus 200, and the developer is supplied out.

In FIGS. 28-30, the sealing member 2 is provided with a sealing portion 2*b* for unsealably sealing the discharge opening 1*a* of the developer supply container 1. The sealing portion 2*b* is provided with a seal portion 2*a* having a diameter larger than an inner diameter of the discharge opening 1*a* by a proper amount. Since the seal portion 2*a* seals the discharge opening 1*a* by press-fitting relative to the inner wall 1*b*, it has a proper elasticity preferably.

(Elastic Deformation Portion)

Referring to FIGS. 28-30, the elastic deformation portion 2*c* will be described. The sealing member 2 is provided with a plurality of elastic deformation portions 2*c*.

The elastic deformation portions 2*c* of sealing member 2 each include one engaging projection 3. The elastic deformation portion 2*c* is easily elastically deformable by the engaging projection 3 being pressed inwardly (arrow D direction in part (e) of FIG. 29) in the radial direction by the sealing member engaging portion 20. Furthermore releasing projections 4 are provided correspondingly to the respective engaging projection 3, and the engaging projection 3 and the releasing projection 4 are integral with each other through the elastic deformation portion 2*c*.

On the other hand, a locking hole 20*h* of the sealing member engaging portion 20 provided in the developer receiving apparatus 200 is locked with a locking surface 3*b* of the sealing member 2.

(Engaging Projection)

The engaging projection 3 projects outwardly in the radial direction beyond a cylindrical surface of the elastic deformation portion 2*c*. The engaging projection 3 has a locking surface 3*b* which functions as a locking portion for locking in a snap fit like manner the sealing member 2 with a locking hole 20*h* as a portion-to-be-locked of the developer receiving apparatus 200 when the developer supply container 1 and the sealing member 2 are separated from each other (the discharge opening 1*a* is opened from the closed state). The sealing member 2 is provided with a slit 2*e* for making the elastic deformation easy. When the engaging projection 3 or the releasing projection 4 is pushed radially inwardly (arrow D direction), the elastic portion elastically deforms radially inwardly (arrow D direction), and when released from the pushing, it elastically restores radially outwardly (in the direction opposed to the arrow D direction).

That is, as shown in FIG. 30, the engaging projection 3 functions to engage with the sealing member engaging portion 20 (retaining function) by the elastic deformation portion 2*c* and the locking surface 3*b* to open and close the discharge opening 1*a* by relative sliding movement between the developer supply container 1 and the sealing member 2 (arrow A direction).

The engaging projection 3 is provided with a taper surface 3*c* to accomplish smooth insertion, when the sealing member 2 is inserted into the sealing member engaging portion 20 of the developer receiving apparatus 200.

As shown in FIG. 26, when the developer supply container 1 is inserted into the developer receiving apparatus 200 in the direction indicated by the arrow A, the engagement between the sealing member engaging portion 20 and the sealing member 2 starts sooner or later, so that the tapered surface 3*c* and the engaging projection 3 receive an urging force from the inner surface of the sealing member 2, by which the elastic deformation portion 2*c* deforms radially inwardly. With further insertion of the developer supply container 1, the tapered surface 3*c* and the engaging projection 3 are released from the inner surface of the sealing member engaging portion 20. Then, the elastic deformation portion 2*c* restores from the elastically deformed state, by which the locking between the sealing member (locking portion) 2 And the developer receiving apparatus (portion-to-be-locked) 200 is completed.

After the completion of the locking, the sealing member 2 is slid in the arrow A direction to separate the sealing member 2 and the developer supply container 1 from each other, by which the discharge opening 1*a* is open to enable the discharge of the developer. In Embodiment 2, the discharge opening 1*a* is opened and closed by the sealing member 2 being moved in the forward (A direction in FIG. 30) or backward (FIG. 30, B direction in FIG. 30, B) directions in the state that the movement of the flange portion 41 in the sliding direction is limited by the engagement of the flange portion 41 fixed to the container body 1A and the developer receiving apparatus 200. As a alternative structure, the discharge opening 1*a* may be opened and closed by the container body 1A being moved in the forward (A direction in FIG. 30) or backward (FIG. 30, B direction in FIG. 30, B) directions in the state that the movement of sealing member 2 in the sliding direction is limited by the engagement with the developer receiving apparatus 200.

(Releasing Projection)

Referring to FIGS. 28-30, the releasing projection 4 provided the corresponding to the engaging projection 3 will be described. The releasing projection 4 is a projection for releasing the locking state of the sealing member 2 relative to the sealing member engaging portion 20 when the developer supply container 1 is exchanged, and after the releasing, the used developer supply container 1 is taken out, and a fresh developer supply container 1 is inserted.

The releasing projection 4 functions to release the locking state between the engaging projection 3 and the sealing member engaging portion 20 by the elastic deformation portion 2*c* being deformed radially inwardly by the releasing projection 4 being pushed by a sliding movement (B direction of FIG. 30) of a releasing member 21 of the developer receiving apparatus 200.

In this embodiment, the engaging projections 3 and the releasing projections 4 constitute respective pairs at the positions dividing into quarters in the circumferential direction, but the number of the pairs is not restricted to the present invention, and may be two or three.

(Flange Locking Portion)

The description will be made as to a flange locking portion 5 (part (b) of FIG. 28) for locking relative to the flange portion 41, as another function of the sealing member 2.

The flange locking portion 5 is provided with a projection 5*b* projected radially outwardly. The projection 5*b* has a snap fit structure as shown in part (b) of FIG. 28 and functions to lock with a step surface 41*b* (FIG. 30) on the inner wall 1*b* constituting the above-described discharge opening to limit the spacing distance of the sealing member 2.

Furthermore, the flange locking portion 5 has the snap fit structure, and therefore, when the flange locking portion 5 is inserted into the flange portion 41 (arrow B direction in FIG. 30), the flange locking portion 5 easily deforms radially inwardly, and therefore, the insertion is smooth but the removal is difficult.

It is important that the structures of the flange locking portion 5 and the projection 5*b* of the flange locking portion 5 constitute the snap fit structure. Even if the step surface 41*b* has a small step height, a very strong locking force is provided with respect to the thrust direction (A direction in FIG. 30), as a advantage of the snap-fit structure. Therefore, even at the position where the thickness is relatively small as in the case of the inner wall 1*b* constituting the discharge opening, the required locking power between the sealing member 2 and the flange portion 41 can be provided by forming a small height step 41*b* within the range of the thickness.

The above-described sealing member 2 may preferably be produced by injection molding of resin material such as plastic resin material or the like, but another material or manufacturing method is usable, or it may be produced by connecting separate parts. In addition, it has to have the function of hermetical press-fitting engagement relative to the discharge opening 1*a*, and therefore, it is required to have proper strength and elasticity.

Examples of such preferable material include low density polyethylene, polypropylene, straight chain polyamide, Nylon (tradename), high density polyethylene, polyester, ABS (acrylonitrile butadiene styrene copolymer resin material), HIPS (shock-resistant polystyrene) and the like.

In addition, two color molding is usable in which only the seal portion is made of relatively soft material such as an elastomer, and the sealing member 2 is made of the above-described resin material. With such a structure, the contactness is high because the seal portion is made of soft elastomer, and therefore, the sealing property is high, and the force required for opening the sealing member 2 this small, and for this reason, such a structure is preferable. In this example, the main body of the sealing member 2 is made of ABS resin material, and only the seal portion 2*a* is made of elastomer, using two color molding.

(Inserting Operation of the Developer Supply Container)

Referring to FIG. 26, part (a)-part (c) of FIG. 27 and FIG. 30, the inserting operation of the developer supply container 1 in this embodiment will be described.

As shown in FIG. 26, the developer receiving apparatus 200 includes a sealing member engaging portion 20 for opening and closing the sealing member 2 by connection with the developer supply container 1. The sealing member engaging portion 20 is rotatably supported by bearing (unshown) or the like, and is slidable in the arrow A direction or arrow B direction by a driving mechanism (unshown) provided in the developer receiving apparatus 200.

Part (a) of FIG. 27 shows a state halfway of the insertion of the developer supply container 1 into the developer receiving apparatus 200 in the arrow A direction. In this stage, the discharge opening 1*a* (FIG. 30) is still sealed by the sealing member 2.

Part (b) of FIG. 27 shows the state in which the developer supply container 1 has been further inserted in the direction of arrow A, and the engaging projection 3 (part (b) of FIG. 28) provided on the sealing member 2 is engaged with the sealing member engaging portion 20 (retained). The locking between the engaging projection 3 and the sealing member engaging portion 20 has been described in the foregoing, and therefore, the description is omitted here.

At this time, the locking surface 3*b* (part (a) of FIG. 28) as the locking portion provided on the engaging projection 3 is locked with the locking hole 20*h* (FIG. 30) as the portion-to-be-locked with respect to the thrust direction (the direction of the axis P in FIG. 30), and therefore, the sealing member 2 is fixed to the sealing member engaging portion 20 (small play may exist), unless the locking is released.

Part (c) of FIG. 27 shows the state in which after the engagement of the sealing member 2 with the sealing member engaging portion 20, the sealing member 2 is moved away from the flange portion 41 (FIG. 30) so that the discharge opening 1*a* (FIG. 30) is open, and therefore, the developer supply is enabled.

When the driving motor (FIG. 26) is driven in this state, the rotational force is transmitted from the driving gear 25 to the drive receiving portion 1A5, By which the developer supply container 1 rotates to feed and discharge the developer. The sealing member 2 rotates idly relative to the flange portion 41.

In part (c) of FIG. 27, the developer supply container 1 is rotatably supported by the contact between the bottle receiving roller 23 provided on the developer receiving apparatus 200 and the rotation fluctuation regulating portion 1A4, and therefore, is rotatable even by a small driving torque. The bottle receiving roller 23 is rotatably provided on the developer receiving apparatus 200. As described hereinbefore, is developer accommodated in the developer supply container 1 is gradually discharged through the discharge opening 1*a* (FIG. 30), so that the developer is temporarily stored in the developer hopper portion 201*a* (FIG. 27), and is further fed into the developing device 201*b* (FIG. 1) by the screw member 27 (FIG. 27), thus accomplishing the developer supply. The foregoing is the description of the inserting operation of the developer supply container 1.

(Exchanging Operation of Developer Supply Container)

An exchanging operation of the developer supply container 1 will be described. When a substantially total amount of the developer in the developer supply container 1 is consumed with the image formation process operation, developer supply container empty detecting means (unshown) provided in the developer receiving apparatus 200 detects the shortage of the developer in the developer supply container 1. The event is displayed on the displaying means 100*b* (FIG. 3) of a liquid crystal type or the like to notify the user of the event.

The exchange of the developer supply container 1 is carried out by the user through the following steps.

First, the exchange front cover 15 which is in the closing state is opened to the position shown in FIG. 3. Then, by the control of the developer receiving apparatus 200, the sealing member engaging portion 20 is slid in the arrow B direction (FIG. 27), and with the sliding operation of the sealing member engaging portion 20, the sealing member 2 in the state shown in part (c) of FIG. 27 slides in the direction of arrow B (FIG. 27). Then, the sealing member 2 in the position of opening the discharge opening 1*a* is press-fitted into the discharge opening 1*a*, by which the discharge opening 1*a* is closed, and therefore, the state shown in part (b) of Figure view 27 is established. At this time, the locking state between the sealing member 2 and the sealing member engaging portion 20 is maintained.

Then, by the control of the developer receiving apparatus 200, the releasing member 21 (FIG. 30) slides in the arrow B direction (FIG. 27). With further sliding of the releasing member 21, the inner surface of the releasing member 21 starts to push the releasing projection 4 radially inwardly sooner or later. Then, the elastic deformation portion 2*c* deforms radially inwardly, so that the sealing member 2 is released from the sealing member engaging portion 20.

Subsequently, the user pulls out the empty developer supply container 1 released from the developer receiving apparatus 200 in the arrow B direction (FIG. 27) to take it out of the developer receiving apparatus 200. Thereafter, the user inserts a fresh developer supply container 1 into the developer receiving apparatus 200 in the arrow A direction (part (b) of FIG. 27), and then closes the exchange front cover 15. And, the sealing member 2 in the locked state with the sealing member engaging portion 20 by the developer discharge opening operating means is spaced from the developer supply container 1, so that the discharge opening 1*a* is opened (part (c) of FIG. 27). The foregoing is the description of the toner supply container exchanging operation.

(Developer Supply Control by Developer Receiving Apparatus)

The developer supply control by the developer receiving apparatus 200 in Embodiment 2 is the same as that of Embodiment 1, and therefore, the description is omitted.

(Comparison in Supply Accuracy, Image Quality, Rotation Drive Load)

Modified examples 6-10, Embodiment 2 (FIG. 31) will be compared in the supply accuracy, the image quality and the rotation drive load. The supply accuracy, the image quality and the rotation drive load are compared depending on the differences in the arrangement of the drive receiving portion 1A5, the rotation fluctuation regulating portion 1A4 and the phase detecting portion 1A6, which most reflect the effects of the present invention. Embodiment 2, the cam groove 1A3 of Embodiment 1 is not employed. FIG. 31 is a partial enlarged view of Embodiment 2.

Table 2 shows the supply accuracy, the image quality, the rotation drive load of the developer supply container 1 during the developer supply in each of the structures.

TABLE 2

| | Positions with respect to the developer container inserting direction | | | | Supply | Image | Rotational driving |
|---|---|---|---|---|---|---|---|
| Arrangement | Downstream | | | Upstream | accuracy | quality | load |
| Comp. Ex. 2 | — | — | Phase detecting portion | Drive receiving portion | 40% | Δ | ◎ |
| Modified Ex. 6 | — | Drive receiving portion | Phase detecting portion | Fluctuation regulating portion | 20% | ○ | Δ |

TABLE 2-continued

| Arrangement | Positions with respect to the developer container inserting direction: Downstream | | | Upstream | Supply accuracy | Image quality | Rotational driving load |
|---|---|---|---|---|---|---|---|
| Modified Ex. 7 | — | Phase detecting portion | Drive receiving portion | Fluctuation regulating portion | 30% | ◎ | ○ |
| Modified Ex. 8 | — | Fluctuation regulating portion | Drive receiving portion | Phase detecting portion | 30% | ◎ | ○ |
| Modified Ex. 9 | — | Fluctuation regulating portion | Phase detecting portion | Drive receiving portion | 20% | ○ | ◎ |
| Modified Ex. 10 | — | Drive receiving portion | Fluctuation regulating portion | Phase detecting portion | 20% | ◎ | Δ |
| Embodiment 2 | — | Phase detecting portion | Fluctuation regulating portion | Drive receiving portion | 20% | ◎ | ◎ |

In the Table, the values and the signs mean as follows.

The supply accuracy 20% means that supply accuracy is within ±20% relative to the target value. By the arrangement of the phase detecting portion and the rotation fluctuation regulating portion adjacent to each other, the vibration attributable to the rotation fluctuation of the phase detecting portion is limited, so that the detection accuracy by the phase detection flag 62 and the phase sensor 61 is improved. As a result, the phase determination of the baffle member 40 is accurate, and therefore, the supply accuracy is improved, during the toner discharging operation.

The supply accuracy 30% means that supply accuracy is within ±30% relative to the target value. Similarly to the case of supply accuracy equal to 20%, the vibration attributable to the rotation fluctuation of the phase detecting portion can be limited by the rotation fluctuation regulating portion, and therefore, the supply accuracy is improved. However, because the phase detecting portion and the rotation fluctuation regulating portion are not disposed adjacent to each other, the vibration regulating effect is lower, and therefore, the supply accuracy is lower than that in the case of the supply accuracy equals to 20%.

The supply accuracy 40% means that supply accuracy is within ±40% relative to the target value. Because the rotation fluctuation regulating portion is not provided, the supply accuracy is low as compared with the case of supply accuracy of 30%, due to the vibration attributable to the rotation fluctuation of the phase detecting portion.

The image quality ◎ means that the rotational drive transmission and therefore the image quality are improved because the drive receiving portion and the rotation fluctuation regulating portion are disposed adjacent to each other, and therefore, the vibration attributable to the rotation fluctuation of the drive receiving portion can be limited, and the drive transmission is improved.

The image quality ○ means similarly to the case of ◎ that the rotational drive transmission and therefore the image quality are improved because the drive receiving portion and the rotation fluctuation regulating portion are disposed adjacent to each other, and therefore, the vibration attributable to the rotation fluctuation of the drive receiving portion can be limited, and the rotational drive transmission is improved. However, the vibration regulating effect is lower, and the image quality is lower than those in the case of ◎, because the drive receiving portion and the rotation fluctuation regulating portion are not disposed adjacent to each other.

The image quality Δ means that the image quality is lower than that in the case of ○ due to vibration attributable to the rotation fluctuation of the drive receiving portion, because no rotation fluctuation regulating portion is provided.

When the developer supply container 1 is inserted into the developer receiving apparatus 200, the phase detecting portion 1A6, the rotation fluctuation regulating portion 1A4 and the drive receiving portion 1A5 of the flange portion 41 abut to or engage with the phase detection flag 62, the bottle receiving roller 23 and the driving gear 25 provided in the developer receiving apparatus 200 (FIG. 31). Therefore, the outer configurations, in the circumferential direction, of the phase detecting portion (portion-to-be-detected), the rotation fluctuation regulating portion (contact portion) and the drive receiving portion preferably gradually increase from the downstream side with respect to the container inserting direction from the standpoint of user's operationality when the developer supply container 1 is inserted into the developer receiving apparatus 200. From this, the outer configuration of the drive receiving portion in the circumferential direction is limited by the positions and structures of the phase detecting portion, the rotation fluctuation regulating portion and the drive receiving portion, with the result of influence to the drive load when the developer supply container 1 rotates. The influence of the difference in the arrangement and structures of the phase detecting portion, the rotation fluctuation regulating portion, the drive receiving portion on the drive load, and the meaning of the symbols will be described.

Rotation drive load ◎ means that the rotation drive load is the minimum, because the drive receiving portion is disposed in the upstreammost side with respect to the container inserting direction among the phase detecting portion, the rotation fluctuation regulating portion and the drive receiving portion, and therefore, the outer diameter of the drive receiving portion can be the maximum.

Rotation drive load ○ means that the rotation drive load of the drive receiving portion is small because the drive receiving portion is disposed in the second place from the upstreammost side with respect to the container inserting direction among the phase detecting portion, the rotation fluctuation regulating portion and the drive receiving portion, and therefore, the outer diameter of the drive receiving portion can be second largest, but the rotation drive load of the drive receiving portion is larger than in the case of ◎.

Rotation drive load Δ means that the rotation drive load is large because the drive receiving portion is disposed in the third place from the upstreammost side with respect to the container inserting direction among the phase detecting portion, the rotation fluctuation regulating portion and the drive receiving portion, and therefore, the outer diameter of the drive receiving portion is the smallest, and the rotation drive load of the drive receiving portion is larger than in the case of ○.

Comparison Example 2

Comparison example 2 (unshown) will be described. The structure of comparison example 2 is different from that of Embodiment 2 in the arrangement of the drive receiving portion 1A5 and phase detecting portion 1A6 provided on the flange portion 41 (no rotation fluctuation regulating portion 1A4 is employed), the driving gear 25, the phase detection flag 62, the phase sensor 61 and the bottle receiving roller 23, and the other structures are similar to those of Embodiment 2. More particularly, the cam groove 1A3, the phase detecting portion 1A6 and the drive receiving portion 1A5 are positioned in the order named from the downstream side with respect to the inserting direction of the developer supply container 1.

With this arrangement, no rotation fluctuation regulating portion is provided, and therefore, the supply accuracy is poor due to the vibration attributable to the rotation fluctuation of the phase detecting portion, and the supply accuracy is target value ±40%.

As regards the image quality, the image quality is poor due to the vibration attributable to the rotation fluctuation of the drive receiving portion, as compared with the case having the rotation fluctuation regulating portion.

As regards the rotation drive load, when the drive receiving portion is disposed at the upstreammost position with respect to the inserting direction of the container, the outer diameter of the drive receiving portion can be made the maximum, and therefore, the rotation drive load can be made minimum.

Modified Example 6

Modified example 6 (unshown) of Embodiment 2 will be described. In modified example 6, the arrangement of the drive receiving portion 1A5 of the flange portion 41, the rotation fluctuation regulating portion 1A4, the phase detecting portion 1A6, the driving gear 25, the phase detection flag 62, the phase sensor 61 and the bottle receiving roller 23 is different from that of Embodiment 2, and the other structures are similar to those of Embodiment 2. More specifically, the drive receiving portion 1A5, the phase detecting portion 1A6 and the rotation fluctuation regulating portion 1A4 are arranged in the order named from the downstream side with respect to the inserting direction of the developer supply container 1.

With this arrangement, the phase detecting portion and the rotation fluctuation regulating portion are disposed adjacent to each other, and the vibration of the phase detecting portion attributable to the rotation fluctuation can be efficiently limited, and therefore, the improvement in the supply accuracy can be expected over the case of comparison example 2 not employing the rotation fluctuation regulating portion 1A4, and the supply accuracy is approximately target value ±20%.

As regards the image quality, by limiting the vibration attributable to the rotation fluctuation of the drive receiving portion by the rotation fluctuation regulating portion, the drive transmission is improved, and therefore, the improvement in the image quality can be expected as compared with the case of comparison example 2 not employing the rotation fluctuation regulating portion 1A4. However, because the drive receiving portion and the rotation fluctuation regulating portion are not disposed adjacent to each other, the vibration regulating effect and the image quality are poor as compared with the case in which the drive receiving portion and the rotation fluctuation regulating portion are disposed adjacent to each other.

As regards the rotation drive load, the drive receiving portion is disposed in the third place from the upstream side with respect to the container inserting direction among the phase detecting portion (portion-to-be-detected), the rotation fluctuation regulating portion (contact portion) and the drive receiving portion, and therefore, the outer diameter of the drive receiving portion is the minimum, with the result that the rotation drive load is the largest as compared with the case in which the drive receiving portion is disposed in the first or second place from the upstream side with respect to the container inserting direction.

Modified Example 7

Modified example 7 (unshown) of Embodiment 2 will be described. The structure of modified example 7 is different from that of embodiment in the arrangement of the drive receiving portion 1A5 of the flange portion 41, the rotation fluctuation regulating portion 1A4, the phase detecting portion 1A6, the driving gear 25, the phase detection flag 62, the phase sensor 61 and the bottle receiving roller 23, and the other structures are similar to those of embodiment. More specifically, the phase detecting portion 1A6, the drive receiving portion 1A5 and the rotation fluctuation regulating portion 1A4 are arranged in the order named from the downstream side with respect to the inserting direction of the developer supply container 1.

With this arrangement, the vibration attributable to the rotation fluctuation of the phase detecting portion can be limited by the rotation fluctuation regulating portion, and therefore, the improvement in the supply accuracy can be expected over the comparison example 2 not employing the rotation fluctuation regulating portion 1A4. The however, the phase detecting portion and the rotation fluctuation regulating portion are not disposed adjacent to each other, and therefore, the vibration regulating effect is poor as compared with the case in which the phase detecting portion and the rotation fluctuation regulating portion are disposed adjacent to each other, and the supply accuracy is approximately targeted value ±30%.

As regards the image quality, the drive receiving portion and the rotation fluctuation regulating portion are disposed adjacent to each other so that the vibration attributable to the rotation fluctuation of the drive receiving portion is efficiently limited, and therefore, the drive transmission is improved, and the improvement in the image quality can be expected over the case of comparison example 2 not employing the rotation fluctuation regulating portion 1A4.

As regards the rotation drive load, the drive receiving portion is disposed in the second place from the upstream side with respect to the container inserting direction among the phase detecting portion (portion-to-be-detected), the rotation fluctuation regulating portion (contact portion) and the drive receiving portion, and therefore, the outer diameter of the drive receiving portion is the second largest, and for this reason, the rotation drive load of the drive receiving portion can be reduced. However, the rotation drive load is larger than in the case in which the drive receiving portion is disposed in the upstreammost position from the upstream side with respect to the container inserting direction.

Modified Example 8

Modified example 8 (unshown) of Embodiment 2 will be described. In modified example 8, the arrangement of the drive receiving portion 1A5 of the flange portion 41, the rotation fluctuation regulating portion 1A4, the phase detecting portion 1A6, the driving gear 25, the phase detection flag 62, the phase sensor 61 and the bottle receiving roller 23 is different from that of Embodiment 2, and the other structures are similar to those of Embodiment 2. More specifically, the rotation fluctuation regulating portion 1A4, the drive receiving portion 1A5 and the phase detecting portion 1A6 are arranged in the order named from the downstream side with respect to the inserting direction of the developer supply container 1.

With this arrangement, the vibration attributable to the rotation fluctuation of the phase detecting portion can be limited by the rotation fluctuation regulating portion, and therefore, the improvement in the supply accuracy can be expected over the comparison example 2. However, the phase detecting portion and the rotation fluctuation regulating portion are not disposed adjacent to each other, and therefore, the vibration regulating effect is poor as compared with the case in which the phase detecting portion and the rotation fluctuation regulating portion are disposed adjacent to each other, and the supply accuracy is approximately targeted value ±30%.

As regards the image quality, the drive receiving portion and the rotation fluctuation regulating portion are disposed adjacent to each other so that the vibration attributable to the rotation fluctuation of the drive receiving portion is efficiently limited, and therefore, the drive transmission is improved, and the improvement in the image quality can be expected over the case of comparison example 2 not employing the rotation fluctuation regulating portion 1A4.

As regards the rotation drive load, the drive receiving portion is disposed in the second place from the upstream side with respect to the container inserting direction among the phase detecting portion (portion-to-be-detected), the rotation fluctuation regulating portion (contact portion) and the drive receiving portion, and therefore, the outer diameter of the drive receiving portion is the second largest, and for this reason, the rotation drive load of the drive receiving portion can be reduced. However, the rotation drive load is larger than in the case in which the drive receiving portion is disposed in the upstreammost position from the upstream side with respect to the container inserting direction.

Modified Example 9

Modified example 9 (unshown) of Embodiment 2 will be described. In modified example 9, the arrangement of the drive receiving portion 1A5 of the flange portion 41, the rotation fluctuation regulating portion 1A4, the phase detecting portion 1A6, the driving gear 25, the phase detection flag 62, the phase sensor 61 and the bottle receiving roller 23 is different from that of Embodiment 2, and the other structures are similar to those of Embodiment 2. More specifically, the rotation fluctuation regulating portion 1A4, the phase detecting portion 1A6 and the drive receiving portion 1A5 are disposed in the order named from the downstream side with respect to the inserting direction of the developer supply container 1.

With this arrangement, the phase detecting portion and the rotation fluctuation regulating portion are disposed adjacent to each other, and therefore, the vibration of the phase detecting portion attributable to the rotation fluctuation can be effectively limited, and therefore, the supply accuracy is better as compared with the case of comparison example 2 not employing the rotation fluctuation regulating portion 1A4, and the supply accuracy is the target value ±20%.

As regards the image quality, by limiting the vibration attributable to the rotation fluctuation of the drive receiving portion by the rotation fluctuation regulating portion, the drive transmission is improved, and therefore, the improvement in the image quality can be expected over the case of comparison example 1 not employing the rotation fluctuation regulating portion 1A4. However, because the drive receiving portion and the rotation fluctuation regulating portion are not disposed adjacent to each other, the vibration regulating effect and the image quality are poor as compared with the case in which the drive receiving portion and the rotation fluctuation regulating portion are disposed adjacent to each other.

As regards the rotation drive load, when the drive receiving portion is disposed at the upstreammost position with respect to the inserting direction of the container, the outer diameter of the drive receiving portion can be made the maximum, and therefore, the rotation drive load can be made minimum.

Modified Example 10

Modified example 10 (unshown) of Embodiment 2 will be described. In modified example 10, the arrangement of the drive receiving portion 1A5 of the flange portion 41, the rotation fluctuation regulating portion 1A4, the phase detecting portion 1A6, the driving gear 25, the phase detection flag 62, the phase sensor 61 and the bottle receiving roller 23 is different from that of Embodiment 2, and the other structures are similar to those of Embodiment 2. More specifically, the drive receiving portion 1A5, the rotation fluctuation regulating portion 1A4 and the phase detecting portion 1A6 are disposed in the order named from the downstream side with respect to the inserting direction of the developer supply container 1.

With this arrangement, the phase detecting portion and the rotation fluctuation regulating portion are disposed adjacent to each other, so that the vibration of the phase detecting portion attributable to the rotation fluctuation can be effectively limited, and therefore, the supply accuracy is better as compared with the case of comparison example 2 not employing the rotation fluctuation regulating portion 1A4, and the supply accuracy is the target value ±20%.

As regards the image quality, the drive receiving portion and the rotation fluctuation regulating portion are disposed adjacent to each other so that the vibration attributable to the rotation fluctuation of the drive receiving portion is efficiently limited, and therefore, the drive transmission is improved, and the improvement in the image quality can be expected over the case of comparison example 1 not employing the rotation fluctuation regulating portion 1A4.

As regards the rotation drive load, the drive receiving portion is disposed in the third place from the upstream side with respect to the container inserting direction among the phase detecting portion (portion-to-be-detected), the rotation fluctuation regulating portion (contact portion) and the drive receiving portion, and therefore, the outer diameter of the drive receiving portion is the minimum, with the result that the rotation drive load is the largest as compared with the case in which the drive receiving portion is disposed in the first or second place from the upstream side with respect to the container inserting direction.

Embodiment 2

Referring to FIGS. 23, 24, Embodiment 2 will be described. In this embodiment, the arrangement of the drive receiving portion 1A5, the rotation fluctuation regulating portion 1A4 and the phase detecting portion 1A6 of the flange portion 41 is in the other of the phase detecting portion 1A6, the rotation fluctuation regulating portion 1A4 and the drive receiving portion 1A5 from the downstream side with respect to the inserting direction of the developer supply container 1.

With this arrangement, the phase detecting portion and the rotation fluctuation regulating portion are disposed adjacent to each other, and the vibration of the phase detecting portion attributable to the rotation fluctuation can be efficiently limited, and therefore, the improvement in the supply accuracy can be expected over the case of comparison example 2 not employing the rotation fluctuation regulating portion 1A4, and the supply accuracy is approximately target value ±20%.

As regards the image quality, the drive receiving portion and the rotation fluctuation regulating portion are disposed adjacent to each other, and therefore, the vibration of the drive receiving portion due to the rotation fluctuation is efficiently limit, so that the drive transmission is improved, and the improvement in the image quality can be expected over the case of comparison example 2 not employing the rotation fluctuation regulating portion 1A4.

As regards the rotation drive load, when the drive receiving portion is disposed at the upstreammost position with respect to the inserting direction of the container, the outer diameter of the drive receiving portion can be made the maximum, and therefore, the rotation drive load can be made minimum.

In the above-described comparison, the comparison example 2, the modified example 6-10 and the Embodiment 2 are compared in the supply accuracy, the image quality and the rotation drive load, but in the present invention, the drive receiving portion 1A5, the rotation fluctuation regulating portion 1A4 and the phase detecting portion 1A6 may be arranged in any way.

Nevertheless, when the comparison is made in the supply accuracy, the image quality and the rotation drive load, the evaluations are dependent on the arrangement of the drive receiving portion 1A5, the rotation fluctuation regulating portion 1A4 and the phase detecting portion 1A6. The preferable arrangement and structures of the drive receiving portion 1A5, the rotation fluctuation regulating portion 1A4 and the phase detecting portion 1A6 will be described.

As regards the rotation drive load, by the dispositions of the drive receiving portion 1A5 in the upstreammost side with respect to the inserting direction of the container, the outer diameter of the drive receiving portion can be made the largest, by which the rotation drive load can be minimized.

As regards the supply accuracy, by the disposition of the phase detecting portion and the rotation fluctuation regulating portion adjacent to each other, the vibration attributable to the rotation fluctuation of the phase detecting portion can be effectively limited, and therefore, the detection accuracy between the phase detection flag 62 and the phase sensor 61 is improved. As a result, the phase determination of the baffle member 40 can be made precise during the toner discharging, and therefore, the supply accuracy can be improved over comparison example 2 not employing the rotation fluctuation regulating portion 1A4.

As regards the image quality, by the disposition of the drive receiving portion and the rotation fluctuation regulating portion adjacent to each other, the vibration of the drive receiving portion attributable to the rotation fluctuation can be effectively limited, and therefore, the drive transmission is improved, and the improvement in the image quality can be expected over the case of comparison example 2 not employing the rotation fluctuation regulating portion 1A4.

From the foregoing, the optimum structure is that the phase detecting portion 1A6, the rotation fluctuation regulating portion 1A4 and the drive receiving portion 1A5 are arranged in the order named from the downstream side with respect to the container inserting direction that is and the structure of Embodiment 2 is most preferable.

According to this embodiment, by limiting the rotation fluctuation of the developer supply container during the developer supply by the rotation fluctuation regulating portion, the rotation fluctuations of both of the phase detecting portion and the drive receiving portion can be reduced, similarly to the one foregoing embodiments. As a result, the accuracies of both of the drive transmission and the phase detection can be improved. Furthermore, the vibration resulting from the rotation of the developer supply container can be reduced, by which the image quality can be improved.

Other Embodiments

In the foregoing embodiment, the phase detecting portion 1A6 is in the form of a recess (or projection), but the present invention is not limited to the structure. For example, as shown in FIG. 32, the phase detecting portion 1A6 may be in the form of a reflecting surface of silver foil provided on the same surface as the rotation fluctuation regulating portion 1A4. With such a structure, the phase sensor 63 for detecting the phase detecting portion 1A6 provided in the apparatus side is an optical sensor. The structure provides the same effects as with the foregoing embodiments.

In the foregoing embodiments, the image forming apparatus is a printer as an exemplary apparatus, but the present invention is not limited to this. For example, it may be another image forming apparatus such as a copying machine, a facsimile machine on the like, or a multifunction machine having the functions of them. By incorporating the present invention in the developer supply container or the developer supplying system used with the image forming apparatus, the similar effects can be provided.

INDUSTRIAL APPLICABILITY

According to the present invention, the influence, to the portion-to-be-detected, of the driving force received by the drive receiving portion can be reduced.

The invention claimed is:

1. A developer supply container comprising:

a developer accommodating body configured to contain developer;

a developer discharging body in fluid communication with the developer accommodating body, the developer discharging body having a discharge opening to discharge the developer from the developer discharging body, with the developer accommodating body being rotatable about a rotational axis relative to the developer discharging body;

a gear portion rotatable about the rotational axis integrally with the developer accommodating body; and a rotatable portion integrally molded with the gear portion, wherein the rotatable portion is provided with a circumferential surface extending along an imaginary circle about the rotational axis, the circumferential surface including an arcuate surface portion extending along the imaginary circle and a recessed surface portion recessed from the imaginary circle toward the rotational axis.

2. The developer supply container according to claim 1, wherein the discharge opening provided in a bottom portion of the developer discharging body to discharge the developer from the developer discharging body to an outside of the developer supply container at the bottom portion.

3. The developer supply container according to claim 1, wherein a plurality of such recessed portions are provided.

4. The developer supply container according to claim 1, wherein a plurality of such arcuate portions are provided.

* * * * *